US006017690A

United States Patent [19]

Nakahira et al.

[11] Patent Number: 6,017,690

[45] Date of Patent: Jan. 25, 2000

[54] SILVER HALIDE PHOTOGRAPHIC MATERIAL AND METHOD OF FORMING IMAGES USING THE SAME

[75] Inventors: Shinichi Nakahira; Toyohisa Oya, both of Minami Ashigara, Japan

[73] Assignee: Fuji Photo Film Co., Ltd., Ashigara, Japan

[21] Appl. No.: 09/274,773

[22] Filed: Mar. 24, 1999

[30] Foreign Application Priority Data

Mar. 26, 1998 [JP] Japan ..... 10-079993

[51] Int. Cl.[7] ..... G03C 1/035

[52] U.S. Cl. ..... 430/567; 430/570

[58] Field of Search ..... 430/567, 570

[56] References Cited

U.S. PATENT DOCUMENTS 5,418,124 5/1995 Suga et al. ..... 430/567
5,443,946 8/1995 Asami ..... 430/567

FOREIGN PATENT DOCUMENTS 6-230501 8/1994 Japan .
7-5614 1/1995 Japan .

*Primary Examiner*—Hoa Van Le
*Attorney, Agent, or Firm*—Birch, Stewart, Kolasch & Birch, LLP

[57] ABSTRACT

A silver halide photographic material having on a support at least one light-sensitive emulsion layer which comprises silver halide grains having a silver chloride content of at least 95 mole %: wherein the silver halide grains each have a phase containing silver iodide in a proportion of at least 0.1 mole % for every 1 mole of total silver halides constituting the grains in the surface part situated outside the central part occupying at least 50% of the volume of each grain and, outside of this part, have no silver iodide-free layer or further have a silver iodide-free layer continuously or discontinuously the thickness of which is 0.002 $\mu$m or below, and the emulsion layer further comprises a particular benzothiamonomethinecyanine sensitizing dye.

11 Claims, No Drawings

SILVER HALIDE PHOTOGRAPHIC MATERIAL AND METHOD OF FORMING IMAGES USING THE SAME

FIELD OF THE INVENTION

The present invention relates to a silver halide photographic material and a method of forming images with the silver halide photographic material. Specifically, it concerns a silver halide photographic material having improved rapid processing suitability, a substantial reduction of color stain attributable to sensitizing dyes remaining in minimum density areas after processing and a slight change in sensitivity during the storing period between the production and the use, and an image formation method in which such a photographic material is utilized.

BACKGROUND OF THE INVENTION

The need for improvement in rapid processing suitability of silver halide photographic materials is still strong in the photographic industry.

In the developing processing of silver halide photographic materials after imagewise exposure, these materials are usually subjected to continuous processing with an automatic developing machine installed in a photofinishing laboratory. As a means to render an acceptable service to users, for instance, it has been required that the photographic materials be developed and returned to the user thereof in the course of the day of their acceptance. Recent years have made even a request that the photographic materials be developed and returned to the user thereof within one hour after acceptance. Thus, the rapid processing is of ever-increasing necessity. Further, since reduction in processing time increases efficiency and diminishes cost of output, this point also constitutes an important factor in the need for urgent development in the rapid processing arts.

Under these circumstances, the shape, the size and the composition of silver halide emulsion grains used in a photosensitive material are known to have great influences upon the development speed and so on. For instance, it is known that the development proceeds at a higher speed the smaller is the emulsion grain size or the higher is the chloride content in silver halide emulsion grains. Therefore, it becomes important to make efficient use of those factors in designing rapid processable photographic materials.

In order to avoid lowering the sensitivity as far as possible in a case of using silver halide grains reduced in size, it is desirable that the amount of spectral sensitizing dyes adsorbed to silver halide grains be set at a high level. Since the surface area per volume of each silver halide grain increases proportionally to reduction in size of each silver halide grain, it is required to use spectral sensitizing dyes in a greater amount the smaller the silver halide grains used are in size. Further, it is known that, as they are greater in surface area per volume than isotropic grains, tabular silver halide grains can increase the quantity of spectral sensitizing dyes adsorbed thereto to gain an advantage in the achievement of high sensitivity over isotropic grains. Accordingly, it is a difficult problem to avoid increasing the amount of spectral sensitizing dyes used in the case where despite using silver halide grains having the smallest possible size so as to have an advantage in rapid processing suitability, the acquisition of high sensitivity is intended.

However, it is also known that such an increase in the amount of sensitizing dyes used poses new problems. In particular, the color stain due to spectral sensitizing dyes remaining in a photosensitive material after photographic processing (the so-called residual color) constitutes an obstacle to the speedup of photographic processing. Because of this residual color problem, a contradiction is incurred between the difficulty in using silver halide grains with a small size and the advantage of rapid processing suitability obtained from the use thereof.

It is disclosed in JP-A-6-230501 (the term "JP-A" as used herein means an "unexamined published Japanese patent application") that the aforementioned drawback of causing residual color can be mitigated by using a spectral sensitizing dye having as a substituent an aromatic group having a special structure, other than a phenyl group, in a silver halide photographic material.

As a result of extensive investigation, it has been confirmed that the residual color in a photosensitive material was reduced by the use of the spectral sensitizing dye disclosed in the above-cited patent. Although the residual color became less than those caused by conventional phenyl group-containing dyes so long as the dye disclosed in the above-cited patent, which had as a substituent the aromatic group of a specified structure, was used, it couldn't be said that the residual color problem was solved completely, but the photosensitive material still suffered coloration due to the sensitizing dyes remaining in the unexposed area after photographic processing. The coloration problem caused by the residue of spectral sensitizing dyes became serious particularly in the case of using small-size or tabular silver halide grains having a great surface area per volume, whereto a large amount of dyes are adsorbed, provided that the amount of dyes used per surface area is set at the same value, compared with other cases. Further, it turned out that this coloration problem became a great obstacle to the reduction of processing time for the speedup of photographic processing.

As a result of further extensive investigation, on the other hand, it has been also confirmed that the foregoing residual color problem was able to be solved more effectively by the photosensitive materials using the sensitizing dyes free from the features of the above-cited patent, i.e., the sensitizing dyes having such a structure as to contain no aromatic group as a constituent. However, such photosensitive materials, as disclosed in comparative examples in JP-A-7-5614, were unable to withstand practical use because of their serious drawback of causing a sensitivity drop upon storage prior to exposure.

As far as conventional arts are used, it is therefore very difficult to obtain a silver halide photographic material having much less residual color than ever, being inhibited from lowering its sensitivity during the storage prior to exposure and having rapid processing suitability.

SUMMARY OF THE INVENTION

The present invention has been made in view of the aforementioned situation, and an object of the present invention is therefore to provide a silver halide photographic material which is well suited for rapid processing, has a reduced change in sensitivity upon storage in the unexposed state (or raw stock storage stability) and decreases the amount of spectral sensitizing dyes remaining after photographic processing, and further to provide an image formation method utilizing such a photographic material.

The above-described objects of the present invention are attained with the following embodiments (1) to (4):

(1) A silver halide photographic material which comprises a support having provided thereon at least one light-sensitive emulsion layer containing silver halide grains having a silver chloride content of at least 95 mole %; wherein the silver halide grains each has a phase containing silver iodide in a proportion of at least 0.1 mole % for every 1 mole of total silver halides constituting the grains in the surface part situated outside the central part occupying at least 50% of the volume of each grain and, outside of this part, has no silver iodide-free layer or further has a silver iodide-free layer continuously or discontinuously the thickness of which is 0.002 μm or below; and the emulsion layer further comprises a compound represented by the following formula (I):

(I)

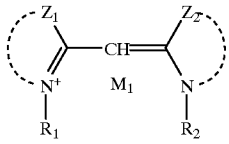

wherein $Z_1$ and $Z_2$ independently represent nonmetal atoms completing a benzothiazole ring which may have a substituent, excluding aromatic hydrocarbon groups and aromatic heterocyclic groups, or is fused together with —O—$CH_2$—O—; $R_1$ and $R_2$ independently represent an alkyl group; and $M_1$ represents a counter ion for neutralizing the intramolecular charge, or it is absent when the compound forms an inner salt.

(2) A silver halide photographic material according to the aforementioned embodiment (1), wherein at least 50%, on a projected area basis, of the total silver halide grains comprised in the light-sensitive emulsion layer are tabular grains having an aspect ratio of at least 2 and (100) major surfaces.

(3) A silver halide photographic material according to the aforementioned embodiment (1) or (2), wherein each of the silver halide grains has (100) faces as substantially all the outer surfaces thereof.

(4) An image formation method comprising steps of exposing, color-developing and washing or/and stabilizing a silver halide photographic material according to the aforementioned embodiment (1), (2) or (3), wherein the total time required for the washing and stabilizing steps is within 30 seconds and the processing time from the start of development to the end of the washing or stabilizing step as the last step is within 90 seconds.

DETAILED DESCRIPTION OF THE INVENTION

The present invention is described below in more detail.

First, the compound of formula (I) is illustrated in further detail.

$Z_1$ and $Z_2$ in formula (I) are independent of each other, and each of them represents nonmetal atoms completing a benzothiazole ring. The benzothiazole ring completed by $Z_1$ or $Z_2$ contains as a substituent neither an unsubstituted or substituted aromatic hydrocarbon group nor an unsubstituted or substituted aromatic heterocyclic group.

Suitable examples of a benzothiazole ring completed by $Z_1$ and $Z_2$ each include benzothiazole, 5-cyanobenzothiazole, 4-chlorobenzothiazole, 5-chlorobenzothiazole, 6-chlorobenzothiazole, 5-nitrobenzothiazole, 4-methylbenzothiazole, 5-methylthiobenzothiazole, 5-methylbenzothiazole, 6-methylbenzothiazole, 5-bromobenzothiazole, 6-bromobenzothiazole, 5-iodobenzothiazole, 5-methoxybenzothiazole, 6-methoxybenzothiazole, 6-methylthiobenzothiazole, 5-ethoxybenzothiazole, 5-ethoxycarbonylbenzothiazole, 5-carboxybenzothiazole, 5-fluorobenzothiazole, 5-chloro-6-methylbenzothiazole, 5,6-dimethylbenzothiazole, 5,6-dimethylthiobenzothiazole, 5,6-dimethoxybenzothiazole, 5-hydroxy-6-methylbenzothiazole, tetrahydrobenzothiazole and 5,6-methylenedioxybenzothiazole. Of these rings, benzothiazole, 5-cyanobenzothiazole, 4-chlorobenzothiazole, 5-chlorobenzothiazole, 5-bromobenzothiazole, 6-bromobenzothiazole, 5-iodobenzothiazole, 5-methoxybenzothiazole, 5-ethoxycarbonylbenzothiazole, 5-carboxybenzothiazole, 5-fluorobenzothiazole, 5-chloro-6-methylbenzothiazole, 5,6-dimethylthiobenzothiazole, 5,6-dimethoxybenzothiazole and 5-hydroxy-5-methylbenzothiazole are preferred over the others. Such a benzothiazole ring completed by $Z_1$ or $Z_2$ may have a substituent, such as an alkyl group, an alkenyl group, a cycloalkyl group, a heterocyclic group (not heteroaromatic), a halogen atom, an alkyl or aryloxy group, an alkyl or arylthio group, an alkyl or arylsulfonyl group, an alkyl or aryloxycarbonyl group, an acyl group, an acyloxy group, an amino group, an alkylamino group, an arylamino group, an acylamino group, a sulfonamide group, an imido group, a sulfamoyl group, a carbamoyl group, an ureido group, an urethane group, a hydroxyl group, a cyano group, a nitro group, a carboxyl group or a sulfo group, preferably alkyl, halogen, alkoxy or cyano, more preferably chlorine, bromine, iodine, methyl, methoxy or cyano.

Examples of an alkyl group represented by $R_1$ and $R_2$ each include a methyl group, an ethyl group, a propyl group, a butyl group, a pentyl group and an octyl group. Such an alkyl group may have a substituent, such as carboxyl, sulfo, cyano, fluorine, chlorine, bromine, hydroxyl, methoxycarbonyl, ethoxycarbonyl, phenoxycarbonyl, benzyloxycarbonyl, methoxy, ethoxy, benzyloxy, phenetyloxy, phenoxy, p-tolyloxy, acetyloxy, propionyloxy, acetyl, propionyl, benzoyl, mesyl, carbamoyl, N,N-dimethylcarbamoyl, morpholinocarbonyl, piperidinocarbonyl, sulfamoyl, N,N-dimethysulfamoyl, morpholinosulfonyl, piperidinosulfonyl, phenyl, 4-chlorophenyl, 4-methylphenyl or α-naphthyl.

Preferably, $R_1$ and $R_2$are each methyl, ethyl, n-propyl, n-butyl, n-pentyl, n-hexyl, 2-carboxyethyl, carboxymethyl, 2-sulfoethyl, 3-sulfopropyl, 4-sulfobutyl or 3-sulfobutyl.

$M_1$, is introduced in formula (I) in order to show the presence or absence of a cation or anion required for neutralizing the ionic charge of a dye represented by the formula (I). Typical examples of such a cation include inorganic and organic ammonium ions and alkali metal ions; while such an anion may be an inorganic or organic one, with examples including halogen anions (e.g., fluoride ion, chloride ion, bromide ion, iodide ion), substituted arylsulfonate ions (e.g., p-toluenesulfonate ion, p-chlorobenzenesulfonate ion), aryldisulfonate ions (e.g., 1,3-benzenedisulfonate ion, 1,5-naphthalenedisulfonate ion, 2,6-naphthalenedisulfonate ion), alkylsulfate ions (e.g., methylsulfate ion), sulfate ion, thiocyanate ion, perchlorate ion, tetrafluoroborate ion, picrate ion, acetate and trifluoromethanesulfonate ion.

Examples of a counter ion preferred as $M_1$ include triethylammonium ion, pyridinium ion, sodium ion, iodide ion and p-toluenesulfonate ion.

The spectral sensitizing dyes represented by formula (I) can be synthesized according to the methods described in F. M. Harmer, *Heterocyclic Compounds—Cyanine Dyes and Related Compounds*, John Wiley & Sons Co., New York London (1964); U.S. Pat. Nos. 3,582,344 and 2,734,900; and A. I. Tolmachev et. al., *Dokl. Akad. Nauk SSSR*, vol. 177, pp. 869–872 (1967), *Ukr. Khim. Zh.,* vol. 40, No. 6, pp. 625–629 (1974), and *Zh. Org. Khim.,* vol. 15, No. 2, pp. 400–407 (1979).

The present compounds of formula (I) are exemplified below, but it should be understood that these exemplified compounds are not to be construed as limiting the scope of the invention in any way.

I-(1)

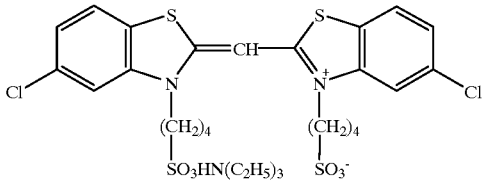

I-(2)

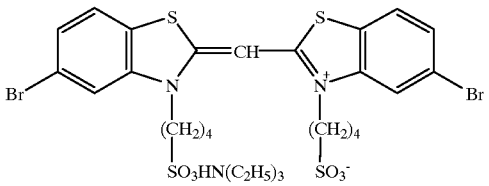

I-(3)

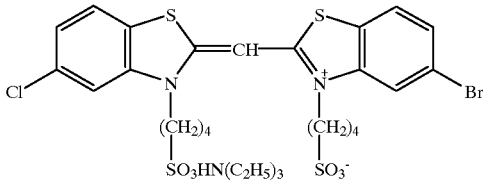

-continued

I-(4)

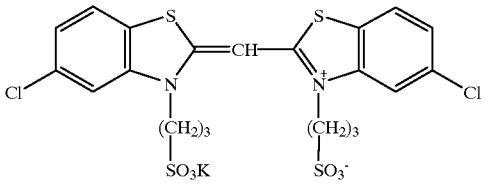

I-(5)

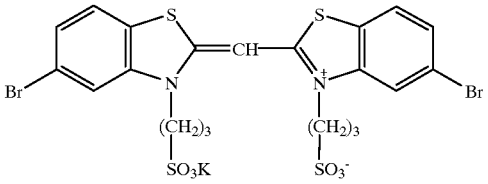

I-(6)

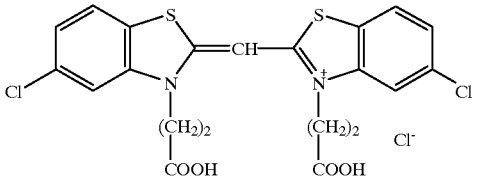

I-(7)

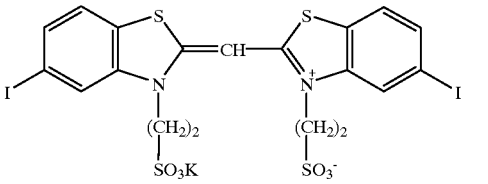

I-(8)

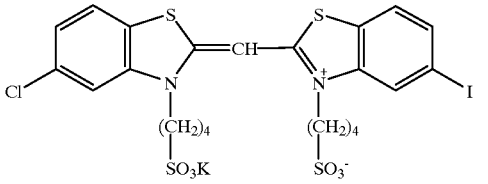

I-(9)

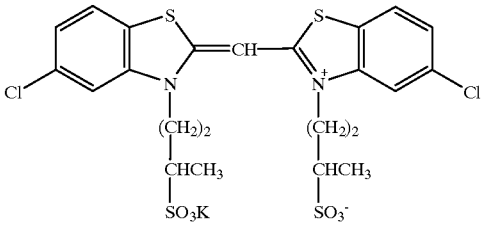

I-(10)

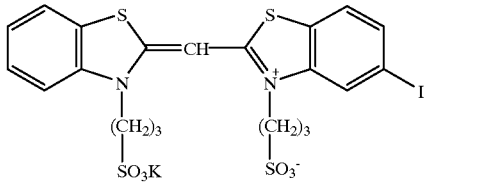

-continued
I-(11)
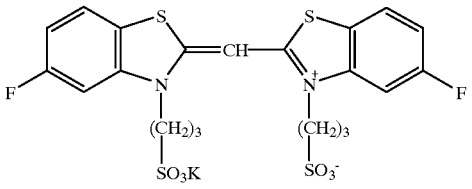
I-(12)
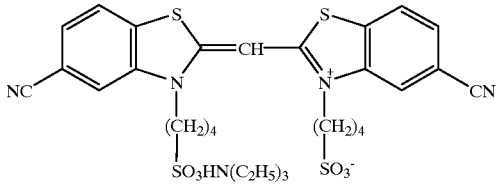
I-(13)
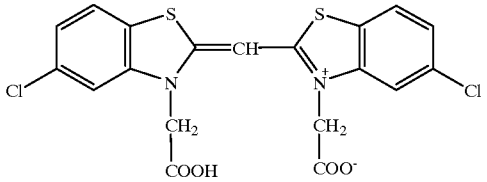
I-(14)
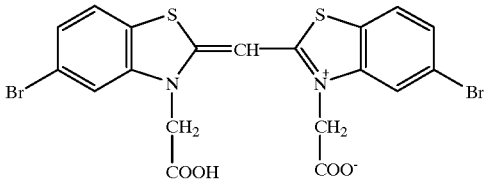
I-(15)
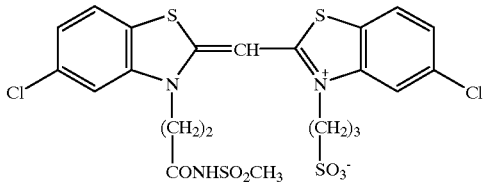
I-(16)
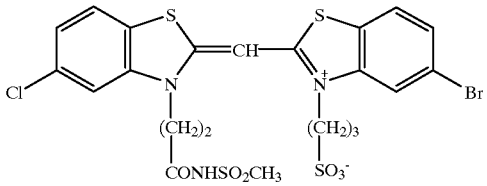
I-(17)
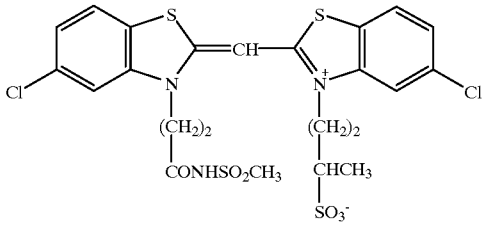
-continued
I-(18)
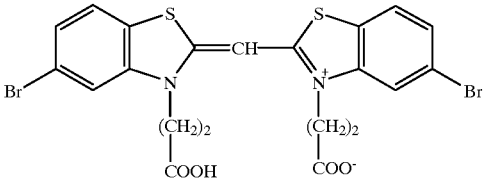
I-(19)
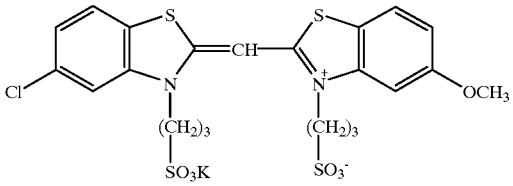
I-(20)
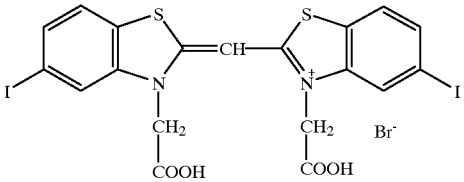
I-(21)
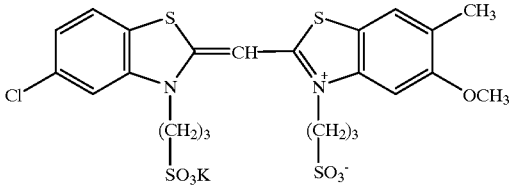
I-(22)
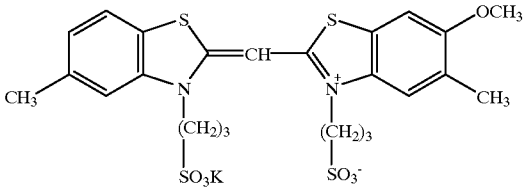
I-(23)
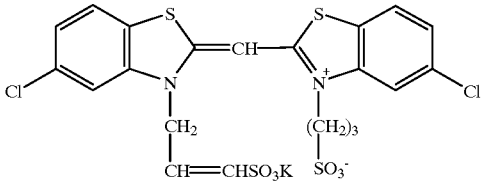
I-(24)
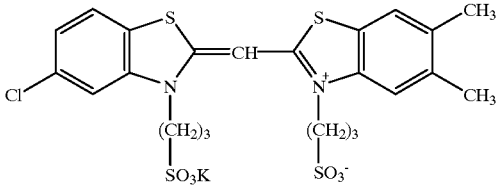

-continued

I-(25)

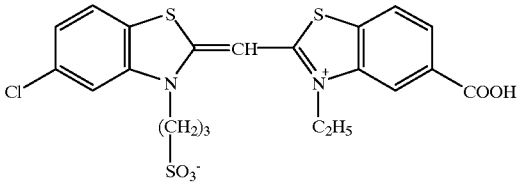

I-(26)

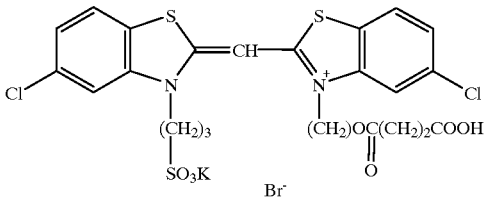

I-(27)

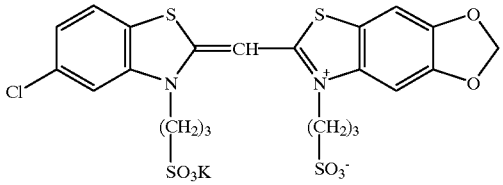

I-(28)

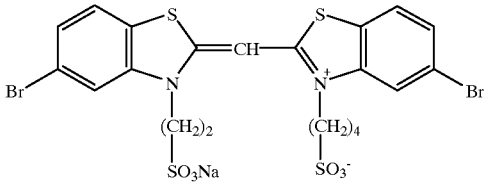

I-(29)

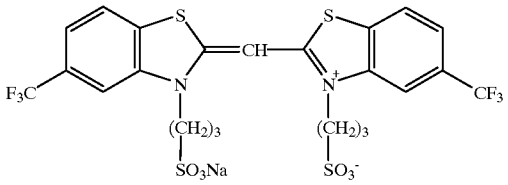

I-(30)

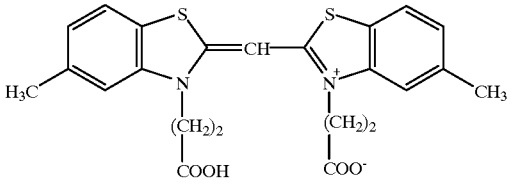

I-(31)

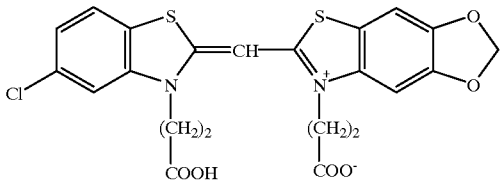

-continued

I-(32)

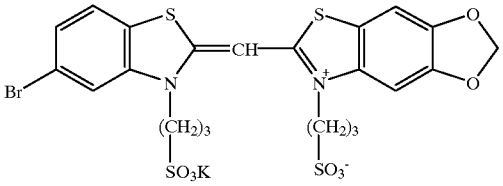

I-(33)

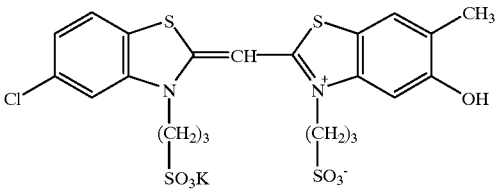

I-(34)

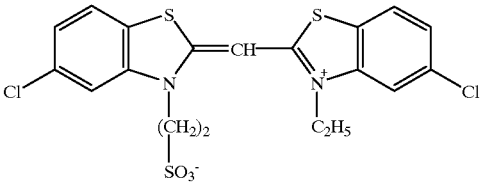

I-(35)

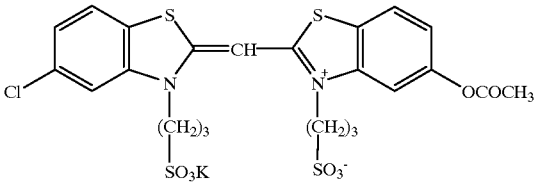

I-(36)

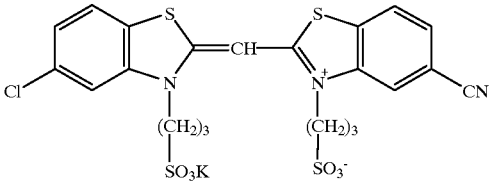

The emulsion constituting each light-sensitive layer in the present photographic material undergoes spectral sensitization in order to gain spectral sensitivities in the intended wavelength region.

In the present invention, it is desirable that the spectral sensitizing dyes of formula (I) be used in a blue-sensitive emulsion layer.

In using spectral sensitizing dyes represented by formula (I) in the present silver halide photographic material, the usages described in JP-A-62-215272 are desirably adopted.

Specifically, the incorporation of these spectral sensitizing dyes into a silver halide emulsion may be effected by dispersing them directly into the emulsion, or by first dissolving them in an appropriate solvent, such as water, methanol, ethanol, propanol, methyl cellosolve, 2,2,3,3-tetrafluoropropanol or a mixture of two or more thereof, and then adding it to the emulsion. Further, the spectral sensitizing dyes can be incorporated into an emulsion according to, e.g., the method as described in JP-B-44-23389, JP-B-44-27555 and JP-B-57-22089 (the term "JP-B" as used herein means an "examined Japanese patent publication"), wherein the dyes are made into an aqueous solution in the presence of an acid or base and then added to the emulsion; the method as described in U.S. Pat. Nos. 3,822,135 and 4,006,025, wherein the dyes are made into an aqueous solution or colloid dispersion in the presence of a surfactant and then added to the emulsion; the method in which the dyes are dissolved in a solvent substantially immiscible with water, such as phenoxyethanol, dispersed into water or a hydrophilic colloid, and then added to the emulsion; or the method as described in JP-A-53-102733 and JP-A-58-105141, wherein the dyes are dispersed directly into a hydrophilic colloid, and then added to the emulsion.

The time for the present sensitizing dyes to be added to a silver halide emulsion may be in any stage of emulsion-making as far as it has hitherto been admitted to be useful. More specifically, the sensitizing dyes can be added before or during the formation of emulsion grains, during the period from just after the grain formation to the start of washing, before or during the chemical sensitization, during the period from just after the chemical sensitization till the caking of the emulsion by cooling, or during the preparation of a coating solution.

In general, they are added during the period from the end of chemical sensitization to the start of emulsion coating. However, it is also possible to add them at the same time of the addition of chemical sensitizers to effect spectral sensitization and chemical sensitization simultaneously, as disclosed in U.S. Pat. Nos. 3,628,969 and 4,225,666; or add them prior to the chemical sensitization as disclosed in JP-A-58-113928; or add them before the completion of precipitation of silver halide grains to start the spectral sensitization. In addition, as disclosed in U.S. Pat. No. 4,225,666, it is possible to add the spectral sensitizing dyes in separate periods; namely, a part of them is added before chemical sensitization and the remainder is added after chemical sensitization. Further, the addition may be carried out according to the method taught by U.S. Pat. No. 4,183,756, or at any stage of grain formation.

In particular, the addition of the present sensitizing dyes before washing the emulsion or chemically sensitizing the emulsion is advantageous to the present photographic material.

The appropriate amount of the present spectral sensitizing dyes of formula (I) added, though it can extent over a wide range depending on the intended purpose, is from $0.5\times10^{-6}$ to $1.0\times10^{-2}$ mole per mole of silver halide, preferably from $1.0\times10^{-6}$ to $5.0\times10^{-3}$ mole per mole of silver halide.

The halide composition of the present silver halide grains is illustrated below.

The present silver halide grains are characterized by having a phase containing silver iodide in a proportion of at least 0.1 mole % for every 1 mole of total silver halides constituting the grains in the surface part situated outside the central part occupying at least 50% of the volume of each grain. The expression "the phase containing silver iodide" used herein refers to the area having a higher local silver iodide content relative to the other areas of each grain. The local silver iodide content in the phase has no other particular restriction, but it is desirably from 0.2 to 100 mole %, more desirably from 0.4 to 13 mole %, particularly desirably from 1 to 5 mole %, of the total silver halides in the phase. The halide composition, other than silver iodide, in the silver iodide-containing phase comprises chloride or bromide, but it is desirable that the proportion of chloride to bromide be at least 90%.

The local silver iodide content in the silver iodide-containing phase is desirably uniform in view of avoiding the generation of desensitization streak due to external pressure. Further, it is desirable for the silver iodide-containing phase to have no silver iodide-free layer outside thereof and to form a shell structure which is uniform in silver iodochloride or silver iodochlorosilver bromide content and situated outside the central part occupying at least 50% of the volume of each grain. When each silver halide grain further has a silver iodide-free layer outside the silver iodide-containing phase, the thickness of the iodide-free layer is 0.002 $\mu$m or below. The silver iodide-containing phase has a volume of less than 50%, desirably less than 20%, more desirably less than 10%, of the volume of each grain. Lowering the volume proportion of the silver iodide-containing phase as the local silver iodide content in this phase is maintained makes it possible to reduce the total amount of silver iodide used as the effects of the present invention are retained. The reduction in the total amount of iodide used is desirable in view of the rapid processability and so on. However, when the volume proportion of the silver iodide-containing phase is made too low, it is feared that the distribution of states in the silver iodide-containing phase formation among grains acquires an influence to be reckoned with. Therefore, care should be taken in lowering the volume proportion of the silver iodide-containing phase. In the present silver halide grains, it is desirable that the total silver iodide content be less than 1 mole % per mole of silver halide. Further, the narrower is the distribution of silver iodide contents among grains, the better results can be obtained. Thus, it is desirable that the variation coefficient be 20% or below with respect to the distribution of silver iodide contents among grains.

The silver iodide-containing phase can be favorably formed by adding a water-soluble silver salt and an iodide ion-containing water-soluble halide in accordance with a double jet method to a reaction vessel in which silver halide grains having a high silver chloride content are under formation. Also, it can be effectively formed by the addition of a previously prepared silver iodide-containing fine-grain emulsion alone or in combination with a water-soluble silver salt and/or a water-soluble halide. In the latter case, it is desirable that the silver halide grains in the fine-grain emulsion have no twinning plane.

In addition, from the standpoint of heightening the uniformity of grains in their silver iodide-containing phase, the compounds gradually releasing iodine as disclosed in JP-B-1-285942 can be employed.

Furthermore, it is desirable that the present silver halide grains have a localized phase wherein the silver bromide content is beyond at least 10 mole %. The localized phase having such a high silver bromide content is desirably arranged in the vicinity of the grain surface from the viewpoints of pressure resistance, processing solution dependence and so on. The term "vicinity of the grain surface" used herein refers to the part extending from the outermost surface to the inner side so as to have a volume corresponding to one-fifth, preferably one-tenth, the volume of silver halide grain. The most appropriate arrangement of the silver bromide-containing phase in each grain is such an arrangement that the localized phase having a silver bromide content higher than 10 mole % makes an epitaxial growth on the corners of a cubic grain, a tetradecahetral grain, a tabular grain having (100) major surfaces, or a tabular grain which has (111) face at the corners in addition to (100) major surfaces.

Although the silver bromide content in the localized phase having a high silver bromide content is desirably beyond 10 mole %, too high silver bromide content sometimes imparts disadvantageous properties to the photographic material. For instance, too high silver bromide content causes desensitization when pressure is imposed on the photographic material, or it causes a great change in sensitivity or gradation with the variation in composition of a processing solution. Taking into account these points, it is desirable that the silver bromide content in the localized phase having a high silver bromide content be from 10 to 60 mole %, preferably from 20 to 50 mole %.

In the present silver halide emulsion grains, the proportion of the localized phase having a high silver bromide content to the grain as a whole is desirably from 0.1 to 10%, preferably from 0.5 to 5%, on a silver basis. Such a localized phase can be formed in various ways. For instance, the localized phase can be formed by reacting a water-soluble silver salt with a water-soluble halide in accordance with a single jet method or a double jet method. Also, it can be formed using a conversion method wherein previously formed silver halide grains are converted into silver halide having a lower solubility product. More specifically, the localized phase having a high silver bromide content can be formed by adding a water-soluble bromide solution to host grains, such as cubic grains, tetradecahedral grains, tabular grains having (100) major surfaces, or tabular grains having (111) faces at the corners in addition to (100) major surfaces; or by mixing such host grains as mentioned above with a fine grain emulsion having a smaller grain size and a higher silver bromide content than the host grains, such as a fine grain emulsion of silver bromide, silver chlorobromide, silver iodobromide or silver iodochlorobromide, and then ripening the mixture.

The boundaries between the foregoing silver iodide-containing phase and the foregoing silver bromide-localized phase and other phases differing in halide composition may have clear interfaces respectively or may be rendered obscure by forming mixed crystals depending on the difference in halide composition. Further, a continuous change in structure may occur in the boundary region. The silver iodide content in the silver iodide-containing phase and the silver bromide content in the bromide-localized phase can be determined, e.g., by X-ray diffractiometry (described in, e.g., a book entitled *Shin-Jikken Kagaku Koza* 6 *Kozo Kaiseki*, which means in English "Lectures on New Experimental Chemistry, vol. 6 entitled Structural Analyses", compiled by The Chemical Society of Japan, published by Maruzen).

In incorporating an iridium compound into the present silver halide grains, it is desirable to use at least 50%, preferably at least 80%, of the iridium compound so as to be present at the time of deposition of the foregoing bromide-localized phase. In particular, it is advantageous to form the bromide-localized phase through the addition of a fine-grain silver bromide emulsion previously containing an iridium compound.

The silver halide grains comprised in at least one silver halide emulsion layer, preferably all the silver halide emulsion layers, used in the present invention are silver iodochloride or iodochlorobromide grains having a chloride content of at least 95 mole %, preferably at least 98 mole %.

The silver halide grains comprised in the present emulsion may be the same as or different from one another in halide composition. In the case of using an emulsion which comprises silver halide grains having the same halide composition, it is easy to make the grains uniform in their properties.

The suitable average size of the silver halide grains contained in the present silver halide emulsion (the grain size herein refers to the diameter of the circle having the same area as the projected area of the grain, and the number average thereof is taken in expressing the average grain size) is from 0.1 to 2 $\mu$m. As for the distribution of grain sizes, the so-called monodispersed emulsions which have a variation coefficient (the value obtained by dividing the standard deviation of grain size distribution by the average grain size) of 20% or less, preferably 15% or less, more preferably 10%, are preferred. Also from the viewpoint of forming the present silver halide grains so as to be uniform in the silver iodide-containing phase or the silver bromide-localized phase, it is advantageous to make the grain size distribution monodisperse. For the purpose of obtaining a wide latitude, it is favorable to coat a blend of some monodispersed emulsions differing in average grain size in a single layer, or to coat them separately in multiple layers.

Although the present invention can be applied to octahedral grains, tabular grains having (111) major surfaces, and grains whose crystal shape has surfaces of higher Miller indices, the crystal shape appropriate for the present silver halide grains is a cubic shape, a tetradecahedral shape, a tabular shape having (100) major surfaces, or a tabular shape having not only (100) major surfaces but also (111) faces at the corners. Further, cubic or tabular grains substantially free from surfaces of higher Miller indices than (100) are desirable for the present silver halide grains. The expression "substantially free from surfaces of higher Miller indices than (100)" used herein means that at least 95% of the total surface area of grains is occupied by (100) surfaces. In particular, it is preferred as the present silver halide grains to have a cubic or tabular shape in which at least 98% of the total surface area is occupied by (100) surfaces.

In the case of using tabular grains in the present invention, it is desirable that at least 50%, on a projected area basis, of the total grains comprised in the present light-sensitive emulsion layer be tabular grains having an aspect ratio of at least 2, preferably at least 5. The term "aspect ratio" as used herein means "the value obtained by dividing the diameter of the circle having the same area as the major surface of a tabular grain by the distance between the major surfaces (i.e., the thickness) of the tabular grain.

The silver iodochloride or iodochlorobromide emulsions used in the present invention can be made using the methods as described in, e.g., P. Glafkides, *Chimie et Phisique Photographique*, Paul Montel, Paris (1967); G. F. Duffin, *Photographic Emulsion Chemistry*, The Focal Press, London (1966); V. L. Zelikman et al, *Making and Coating Photographic Emulsion*, The Focal Press, London (1964); and so on. Specifically, any processes, including an acid process, a neutral process and an ammoniacal process, may be employed. Suitable methods for reacting a water-soluble silver salt with a water-soluble halide include, e.g., a single jet method, a double jet method, or a combination thereof. Also, a method in which silver halide grains are produced in the presence of excess silver ion (the so-called reverse mixing method) can be employed. On the other hand, the so-called controlled double jet method, in which the pAg of the liquid phase in which silver halide grains are to be formed is maintained constant, may be employed. According to this method, a silver halide emulsion having a regular crystal shape and an almost uniform distribution of grain sizes can be prepared. Further, the tabular grains having (100) major surfaces can be formed by reference to the methods disclosed in, e.g., JP-A-7-168296.

It is desirable to introduce foreign metal ions or complex ions into the localized phase or the substrate of the present silver halide grains. Preferably, such foreign metal ions or complex ions are selected from the group consisting of the groups VIII and IIb metal ions and complex ions, lead ion and thallium ion. In the localized phase, ions or complex ions selected from those of iridium, rhodium and iron can be mainly used; while, in the substrate, ions or complex ions selected from those of osmium, iridium, rhodium, platinum, ruthenium, palladium, cobalt, nickel and iron can be mainly used in combination. There may be differences in species and concentration of metal ions or complex ions used between the localized phase and the substrate. Therein, two or more different metals may be used in combination. Specifically, it is advantageous that iron and iridium compounds be introduced into the silver bromide-localized phase and/or the silver iodide-containing phase. In particular, it is preferable that at least 50%, especially at least 80%, of the iridium compound introduced be present in the bromide-localized phase. The amount of an iridium compound used in the present invention, though depends on the grain size, is from $1\times10^{-9}$ to $10^{-3}$ mole, preferably from $5\times10^{-6}$ to $10^{-5}$ mole, per mole of silver halide.

At the silver halide grains-formation time, compounds capable of providing these metal ions are added to an aqueous gelatin solution as a dispersing medium, an aqueous halide solution, an aqueous silver salt solution or other aqueous solutions, or fine silver halide grains previously containing these metal ions are added and then made to dissolve, and thereby the metal ions are introduced into the localized phase and/or other grain parts (including the substrate) of the present silver halide grains.

The metal ions usable in the present invention can be incorporated into emulsion grains before, during or just after the grain formation. The addition time of metal ions can be changed depending on what region the metal ions are intended to be introduced in.

The silver halide emulsions used in the present invention can be chemically and spectrally sensitized using the compounds in accordance with the methods as disclosed in JP-A-7-168296, par. Nos. (0045)–(0067).

To the silver halide emulsion used in the present invention, various compounds or precursors thereof can be added for the purpose of preventing the photographic material from generating fog in the course of production, storage or photographic processing thereof, or stabilizing photographic properties. Suitable examples of such compounds include the compounds disclosed in the above-cited JP-A-7-168296, par. No. (0060), and the compounds disclosed in JP-A-62-215272, pp. 39–72. In addition, the 5-arylamino-1,2,3,4-thiatriazole compounds (the aryl residue of which has at least one electron-attracting group) disclosed in EP Patent 0447647 are also preferably used.

In the present silver halide photographic material, other conventional substances for photographic use and known additives can be used.

With respect to the support, both transmissive and reflective support can be used in the present invention. Suitable examples of a transmissive support include transmissive films, such as a cellulose acetate film and a polyethylene terephthalate film, and polyester films (produced from, e.g., a combination of 2,6-naphthalenedicarboxylic acid (NDCA) and ethylene glycol (EG), and a combination of NDCA, terephthalic acid and EG) provided with an information recording layer (e.g., magnetic layer). It is desirable for the reflective support to be laminated with two or more polyethylene or polyester layers and contain a white pigment, such as titanium oxide, in at least one of the foregoing waterproof resin layers (laminated layers). Also, the reflective support may be a transmissive or reflective support coated with a white pigment-containing hydrophilic colloid layer.

In addition, the reflective support may be a support having a mirror reflective or second-kind diffused reflective metallic surface. The term second-kind diffused reflection refers to the diffused reflection gained by roughening a specular surface to divide the surface into minute mirrors facing to different directions from one another, and thereby diffusing the directions of divided minute surfaces (minute mirrors). The roughness of the second-kind diffused reflective surface is from 0.1 to 2 $\mu$m, preferably from 0.1 to 1.2 $\mu$m, in terms of the three-dimensional average roughness to the center plane. In cases where the surface roughness is at least 0.1 $\mu$m, the surface roughness frequency is preferably from 0.1 to 2,000 cycles/mm, more preferably from 50 to 600 cycles/mm. The details of such supports are described in JP-A-2-239244.

In the foregoing waterproof resin layers, it is desirable that a fluorescent brightening agent be contained. Further, the fluorescent brightening agent may be dispersed into a hydrophilic colloid layer of the photographic material. Suitable examples of the fluorescent brightening agent include benzoxazole compounds, coumarin compounds and pyrazoline compounds. Further, the fluorescent brightening agents of benzoxazolylnaphthalene and benzoxazolylstilbene types are used to advantage. The amount of the fluorescent brightening agent used is not particularly limited, but it is desirably in the range of 1 to 100 mg/m$^2$. When the fluorescent brightening agent is mixed with a waterproof resin, the suitable proportion of the fluorescent brightening agent to the waterproof resin is from 0.0005 to 3 weight %, preferably from 0.001 to 0.5 weight %.

The hydrophilic colloid layers in the present invention can be formed by the use of a known hydrophilic dispersion medium alone or in combination with another high molecular substance. As a hydrophilic dispersion medium, gelatin is used to advantage. In addition, gelatin derivatives (e.g., phthaloylated gelatin, esterified gelatin), copolymers of gelatin and other polymers, proteins other than gelatin, polysaccharides (e.g., agar, dextran) and synthetic hydrophilic polymers can be also used alone or in combination. These dispersion medium can be hardened satisfactorily with known hardeners. These dispersion media and hardeners usable in the present invention are described in *Research Disclosure*, Item 36544, Section II (September, 1994).

The present silver halide photographic materials are adaptable for any of conventional uses, including black-and-white photographic materials (e.g., a medical X-ray photosensitive material, a photosensitive material for printings, a photographic paper, a negative film, a microfilm, a direct positive photographic material), photosensitive materials for superfine-grain dry plates (e.g., LSI photomask, shadow mask, liquid crystal mask), and color photographic materials (e.g., color photographic paper, color cinematograph film, color negative film, color reversal film, direct reversal color photosensitive materials, silver dye bleach process photographic materials). In addition, the present photographic materials can be favorably used for diffusion transfer photographic materials (e.g., a color diffusion transfer element, a silver salt diffusion transfer element), heat-developable black-and-white and color photosensitive materials, high density digital recording materials and photosensitive materials for holography. Of these materials, it is advantageous to the present photographic materials to be used for color photographic materials, especially for color photographic paper and color cinematograph film.

In using a photographic material according to the present invention as a color photographic material, the photographic material can have a structure in which at least one yellow color forming silver halide emulsion layer, at least one magenta color forming silver halide emulsion layer and at least one cyan color forming silver halide emulsion layer are coated on a support. According to-a subtractive color process, color reproduction in general color photographic paper can be effected by incorporating in each silver halide emulsion layer a color coupler capable of forming a dye which has a complementary color relationship with the color of light to which the silver halide emulsion layer has sensitivity. In the general photographic paper, the silver halide emulsion grains in each of the foregoing color forming layers are spectrally sensitized with each of blue-sensitive, green-sensitive and red-sensitive spectral sensitizing dyes, the order of which corresponds to the above-described order of color forming emulsion layers. And the color forming emulsion layers can be coated on a support in the above-described order. However, the arranging order of those color forming emulsion layers may be different from the above-described one. For instance, it is advantageous in view of rapid processing to arrange a light-sensitive layer comprising silver halide grains with the greatest average size as the topmost layer; while, in view of keeping quality under exposure, it is desirable that the magenta color forming layer be disposed as the lowest layer.

On the other hand, the present photographic material can be constituted so as not to have the foregoing relationships between each light-sensitive layer and the color hue of the developed color therein. Further, at least one infrared-sensitive silver halide emulsion layer may be provided therein.

In incorporating a cyan, magenta or yellow coupler into the present light-sensitive emulsion layer, the loadable latex polymer (as disclosed, e.g., in U.S. Pat. No. 4,203,716) is impregnated with such a coupler in the presence (or absence) of a high boiling organic solvent, or such a coupler is dissolved together with a polymer insoluble in water but soluble in an organic solvent, and then dispersed in an emulsified state into an aqueous solution of hydrophilic colloid. As such a polymer, the homo- and copolymers disclosed in U.S. Pat. No. 4,857,449, columns 7–15, and World Open WO 88/00723, pages 12–30, can be preferably used. Of those polymers, the methacrylate polymers and the arylamide polymers, especially the acrylamide polymers, are preferred from the viewpoint of stabilizing dye images.

In photographic materials according to the present invention, it is desirable to use couplers together with the dye image keeping quality improving compounds as disclosed in EP-A2-0277589. In particular, it is preferable to use such compounds in combination with pyrazoloazole couplers or pyrrolotriazole couplers.

More specifically, the compounds producing chemically inert, substantially colorless compounds by combining chemically with an aromatic amine developing agent remaining after the color development-processing, which are disclosed in the above-cited reference, and/or compounds producing chemically inert, substantially colorless compounds by combining chemically with the oxidized aromatic amine developing agent remaining after the color development-processing, which are also disclosed in the above-cited reference, are preferably used in combination or independently. This is because the use of those compounds enables effective inhibition of the generation of stains due to the formation of dyes through the reaction between the couplers and the unoxidized or oxidized color developing agent remaining in the processed photographic film and the occurrence of other side reactions upon storage after photographic processing.

Examples of a cyan coupler which can be used to advantage include monoacylaminophenol cyan couplers, diacylaminophenol cyan couplers, ureidophenol cyan couplers, naphthol cyan couplers, the pyrrolopyrazole cyan couplers disclosed in EP-A1-0456226, the pyrroloimidazole cyan couplers disclosed in EP-A1-0484909 and the pyrrolotriazole cyan couplers disclosed in EP-A1-0488248 and EP-A1-0491197. Of these cyan couplers, the pyrrolotriazole cyan couplers are preferred over the others.

Examples of a yellow coupler which can be used to advantage include pivaloylacetanilide yellow couplers, benzoylacetanilide yellow couplers, the acylacetamide yellow couplers having a 3- to 5-membered cyclic structure in their respective acyl groups which are disclosed in EP-A1-0447969, the cyclic structure-containing malondianilide yellow couplers disclosed in EP-A1-0482552, the dioxane structure-containing acylacetanilide yellow couplers disclosed in U.S. Pat. No. 5,118,599. These yellow couplers can be used alone or in combination.

Examples of a magenta coupler desirably used in the present invention include 5-pyrazolone magenta couplers and pyrazoloazole magenta couplers. Of these couplers, the pyrazolotriazole couplers as disclosed in JP-A-61-65245, wherein a secondary or tertiary alkyl group is attached directly to the 2-, 3- or 6-position of the pyrazolotriazole ring, the sulfonamido group-containing pyrazolotriazole couplers as disclosed in JP-A-61-65246, the alkoxyphenylsulfonamido ballast group-containing pyrazoloazole couplers as disclosed in JP-A-61-147254 and the pyrazoloazole couplers having an alkoxy or aryloxy group at their respective 6-positions as disclosed in EP-A-0226849 and AP-A-0294785 are preferred in view of hue, image stability and color developability.

With respect to the aforementioned reflective support, silver halide emulsions, foreign metal complex salts doped in silver halide grains, storage stabilizer or antifoggant for silver halide emulsions, chemical sensitization methods (sensitizers), spectral sensitization methods (spectral sensitizers), cyan, magenta and yellow couplers and methods of dispersing them in a emulsified state, dye image keeping quality improvers (stain inhibitors and discoloration inhibitors), dyes (colored layers), gelatin species, layer structures of photographic materials and film pH of photographic materials, those disclosed in the laid-open patent applications shown in Table 1 and Table 2 are applicable preferably to the present invention. The silver halide emulsions set forth in Table 1 are silver halide emulsions usable together with the present silver iodochlorobromide or silver iodochloride emulsion having a chloride content of at least 95 mole %. and the spectral sensitizing dyes set forth in Table 1 are spectral sensitizing dyes usable in combination with the present spectral sensitizing dyes represented by formula (I).

TABLE 1

| Photographic Constituents | JP-A-7-104448 | JP-A-7-77775 | JP-A-301895 |
|---|---|---|---|
| Reflective support | column 7, l. 12 to column 12, l. 9 | column 35, l. 43 to column 44, l. 1 | column 5, l. 40 to column 9, l. 26 |
| Silver halide emulsion | column 72, l. 29 to column 74, l. 18 | column 44, l. 36 to column 46, l. 29 | column 77, l. 48 to column 80, l. 28 |
| Foreign metal ion species | column 74, ll. 19–44 column 47, l. 5 | column 46, l. 30 to column 81, l. 6 | column 80, l. 29 to |
| Storage stabilizer or Antifoggant | column 75, ll. 9–18 | column 47, ll. 20–29 | column 18, l. 11 to column 31, l. 37 (especially Mercapto heterocyclic compounds) |
| Chemical sensitization method (chemical sensitizer) | column 74, l. 45 to column 75, l. 6 | column 47, ll. 7–17 | column 81, l. 9 to 17 |
| Spectral sensitization method (spectral sensitizer) | column 75, l. 19 to column 76, l. 45 | column 47, l. 30 to column 49, l. 6 | column 81, l. 21 to column 82, l. 48 |
| Cyan coupler | column 12, l. 20 to column 39, l. 49 | column 62, l. 50 to column 63, l. 16 | column 88, l. 49 to column 89, l. 16 |
| Yellow coupler | column 87, l. 40 to column 88, l. 3 | column 63, ll. 17–30 | column 89, ll. 17–30 |
| Magenta coupler | column 88, ll. 4–18 | column 63, l. 31 to column 64, l. 11 | column 32, l. 34 to column 77, l. 44, and column 89, ll. 32–46 |
| Emulsified dispersion method of coupler | column 71, l. 3 to column 72, l. 11 | column 61, ll. 36–49 | column 87, ll. 35–48 |

TABLE 2

| Photographic Constituents | JP-A-7-104448 | JP-A-7-77775 | JP-A-301895 |
|---|---|---|---|
| Color image keeping quality improver (stain inhibitor) | column 39, l. 50 to column 70, l. 9 | column 61, l. 50 to column 62, l. 49 | column 87, l. 49 to column 88, l. 48 |
| Discoloration inhibitor | column 70, l. 10 to column 71, l. 2 | | |
| Dye (colored layer) | column 77, l. 42 to column 78, l. 14 | column 7, l. 14 to column 19, l. 42, and column 50, l. 3 to column 51, l. 14 | column 9, l. 27 to column 18, l. 10 |
| Gelatin species | column 78, ll. 42–48 | column 51, ll. 15–20 | column 83, ll. 13–19 |
| Layer structure of photographic material | column 39, ll. 11–26 | column 44, ll. 2–35 | column 31, l. 38 to column 32, l. 33 |
| Film pH of photographic material | column 72, ll. 12–28 | | |

TABLE 2-continued

| Photographic Constituents | JP-A-7-104448 | JP-A-7-77775 | JP-A-301895 |
|---|---|---|---|
| Scanning exposure | column 76, l. 6 to column 77, l. 41 | column 49, l. 7 to column 50, l. 2 | column 82, l. 49 to column 83, l. 12 |
| Preservative in developing solution | column 88, l. 19 to column 89, l. 22 | | |

Although it is essential that the photographic materials according to the present invention be exposed to blue light, they may further be exposed to light in other portions of the visible region and/or infrared rays.

The exposure for forming images in the present photographic materials may be either low illumination intensity exposure or high illumination intensity exposure. At the time of exposure, it is desirable to use the band stop filter as disclosed in U.S. Pat. No. 4,880,726. By the use of such a filter, photo-mixing of colors can be removed to considerably improve the color reproduction.

The present photographic materials are suitable for the scanning exposure system utilizing a cathode-ray tube (CRT) besides the print system using an ordinary nega printer. The CRT exposure apparatus is simple, compact and inexpensive, compared with the apparatus utilizing laser beams. In addition, both optical axis adjustment and color adjustment in that apparatus are easy.

In the cathode-ray tube for image exposure are used various luminous bodies emitting light rays in the desired spectral regions respectively. For instance, a red luminous body, a green luminous body and a blue luminous body are used alone, or in combination of at least two. The spectral regions are not limited to the foregoing red, green and blue regions, but other luminous bodies emitting light rays in the yellow, orange, violet or infrared region can also be used. In particular, cathode-ray tubes in which those luminous bodies are compounded so as to emit white light have been frequently employed.

In a case where the photographic material to be exposed has at least two photosensitive layers differing in spectral sensitivity distribution and the cathode-ray tube having luminous bodies to emit light rays in at least two different spectral regions is employed for the exposure, simultaneous exposure to at least two different colors of light rays may be carried out by simultaneously inputting image signals of at least two different colors to the cathode-ray tube and therefrom emitting light rays of those colors. On the other hand, the exposure may be carried out using a method in which the light rays of different colors are emitted successively from the cathode-ray tube by successively inputting image signals of those colors and the photographic material is exposed to each of these light rays in turn via each film capable of cutting colors other than the color of each emission (which is referred to as successive plane exposure method). In order to achieve high image quality, the successive plane exposure is generally preferred because it enables the use of high-resolution cathode-ray tube.

The present photographic materials are also suitable for digital scanning exposure systems utilizing monochromatic high-density light, such as gas laser, light-emitting diode, semiconductor laser or a second harmonic wave generating light source (SHG) wherein semiconductor laser or solid laser using semiconductor laser as excitation light source is combined with a non-linear optical crystal. In order to make the exposure system compact and inexpensive, it is desirable to use semiconductor laser or a second harmonic wave generating light source (SHG) in which semiconductor laser or solid laser is combined with a non-linear optical crystal. In particular, the use of semiconductor laser is preferred for the purpose of designing a low-priced compact apparatus having a long life and high stability, and it is advantageous to use semiconductor laser as at least one of the light sources for the exposure.

When such scanning exposure light sources are employed, the spectral sensitivity maxima of the present photographic material can be set optionally at the wavelengths depending on those of the light sources used. In the case of utilizing the SHG light source obtained by combining the solid laser using semiconductor laser as an excitation light source or semiconductor laser with a non-linear optical crystal, the oscillation wavelength of laser can be reduced to one-half its initial value, so that blue color light and green color light can be obtained. Therefore, the use of such light sources can permit a photosensitive material to have its spectral sensitivity maxima in usual three wavelength regions, namely blue, green and red wavelength regions.

The suitable exposure-time for the aforementioned scanning exposure is not longer than $10^{-4}$ second, preferably not longer than $10^{-6}$ second, expressed in terms of the time required for exposure of a pixel size when the pixel density is 400 dpi.

Details of scanning exposure systems appropriately applicable to the present invention are described in the patent specifications shown in the foregoing tables.

In processing the present photographic materials, any of conventional processing methods for photosensitive materials containing silver halide emulsions are available In particular, the method for rapidly processing color photographic paper comprising high silver chloride content silver halide emulsions under a low replenishment rate condition can be effectively applied to the present invention. The low replenishment rate condition for the processing in the present invention depends on the type of the photographic material to be processed, and so in a case of adopting the photographic processing for general color photographic paper it means that the total replenishment rate in all processing steps is desirably 200 ml/m$^2$ or less, preferably that the total replenishment rate in all processing steps is 200 ml/m$^2$ or less and the sum of the replenishment rates in bleach-fix and washing and/or stabilization steps is at most 150 ml/m$^2$or less. In a case of adopting the photographic processing for general color negative, on the other hand, the low replenishment rate condition means that the total replenishment rate in all processing steps is desirably 500 ml/m$^2$ or less.

When the washing and/or stabilization time is shorter, the present invention can achieve the greater effect. The suitable sum of the washing time and the stabilization time in the present invention is within 90 seconds, preferably within 45 seconds, particularly preferably within 30 seconds. From the viewpoint of rapid processing, it is desirable in the present invention that the total processing time required from the start of color development to the end of washing and/or stabilization be within 120 seconds, preferably within 90 seconds, particularly preferably within 75 seconds.

In the case of employing the present photographic materials as color photographic paper, it is desirable that their photographic processing include color development, bleach-fix and washing and/or stabilization steps. Therein, it is desirable that at least one, preferably at least two, of processing solutions used in color development, bleach-fix step and washing and/or stabilization steps contain, in a substantial sense, a brightening agent represented by the following formula (II).

In particular, it is preferable that the brightening agent of formula (II) be contained in a color developer (or a processing solution used in the color development step)

(II)

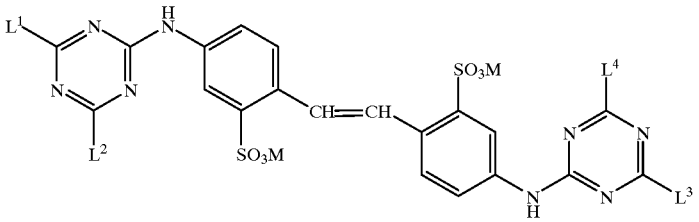

In the above formula, $L^1$, $L^2$, $L^3$ and $L^4$ each represent $—OR^1$, $—NR^2R^3$ or $—N^+R^2R^3R^4X$, and $R^1$, $R^2$, $R^3$ and $R^4$ each represent a straight-chain or branched alkyl group, or a straight-chain or branched alkyl group having a substituent selected from the following members (III):

$$—SO_3M,\ —OSO_3M,\ —COOM,\ —NRX \qquad \text{(III)}$$

wherein X is a halogen ion and R is an alkyl group. Further, $R^2$ in formula (II) may be a hydrogen atom, and M in formulae (II) and (III) each is a hydrogen atom, an alkali metal, an alkaline earth metal, ammonium salt or pyridinium.

Of the compounds of formula (II), the preferred compounds are those which contain in $L^1$, $L^2$, $L^3$ and $L^4$ a total of at least 4 strongly hydrophilic substituents selected from the foregoing members (III). Specifically, the diaminostilbene compounds having the substituents recited in Tables 3 and 4 shown below are used to advantage.

TABLE 3

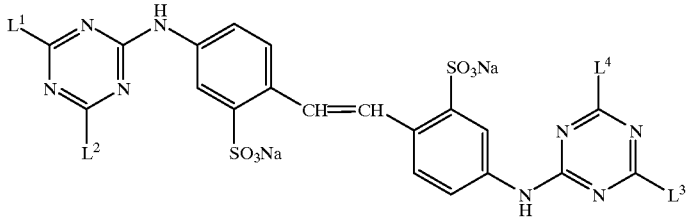

| Compound No. | $L^1 = L^3$ | $L^2 = L^4$ |
|---|---|---|
| SR-1 | $—OC_2H_4SO_3Na$ | $—OC_2H_4SO_3Na$ |
| SR-2 | $—OC_2H_4OSO_3Na$ | $—OC_2H_4OSO_3Na$ |
| SR-3 | $—N(C_2H_4OSO_3Na)_2$ | $—N(C_2H_4OSO_3Na)_2$ |
| SR-4 | $—OC_2H_4SO_3H$ | $—OC_2H_4SO_3H$ |
| SR-5 | $—NHC_2H_4SO_3H$ | $—NHC_2H_4SO_3H$ |
| SR-6 | $—NHC_2H_4SO_3^{\ominus}(NH_4)$ | $—NHC_2H_4SO_3^{\ominus}(NH_4)^{+e,rc+ee}$ |

TABLE 3-continued

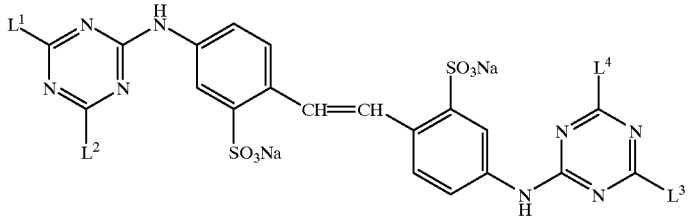

| Compound No. | $L^1 = L^3$ | $L^2 = L^4$ |
|---|---|---|
| SR-7 | $—NHC_2H_4COOH$ | $—NHC_2H_4COOH$ |
| SR-8 | " | $—NHC_2H_4SO_3Na$ |
| SR-9 | $—NHC_2H_4COONa$ | $—NHC_2H_4COONa$ |
| SR-10 | " | $—NHC_2H_4SO_3Na$ |
| SR-11 | $—N^{+e,ctc+tee}(CH_3)_3Cl^{\ominus}$ | $—N^{+e,ctc+tee}(CH_3)_3Cl^{\ominus}$ |
| SR-12 | $—NHC_2H_4SO_3Na$ | $—NHC_2H_4SO_3Na$ |
| SR-13 | $—N(CH_3)(C_2H_4SO_3Na)$ | $—N(CH_3)(C_2H_4SO_3Na)$ |

TABLE 4

| Compound No. | $L^1 = L^3$ | $L^2 = L^4$ |
|---|---|---|
| SR-14 | $—N(C_2H_5)(C_2H_4SO_3Na)$ | $—N(C_2H_5)(C_2H_4SO_3Na)$ |
| SR-15 | $—N(C_2H_4SO_3Na)(C_2H_4SO_3Na)$ | $—N(C_2H_4SO_3Na)(C_2H_4SO_3Na)$ |
| SR-16 | $—N(C_2H_4SO_3Na)(C_2H_4SO_3Na)$ | $—OCH_3$ |
| SR-17 | " | $—OC_2H_5$ |
| SR-18 | " | $—OC_2H_4OH$ |
| SR-19 | " | $—N(C_2H_5)(C_2H_5)$ " |
| SR-20 | " | $—NHC_2H_4OH$ |
| SR-21 | " | $—OC_2H_4NH_2$ |
| SR-22 | " | $—NHCOONH_2$ |
| SR-23 | $—NHC_2H_4SO_3Na$ | $—OC_2H_4SO_3Na$ |
| SR-24 | " | $—N(CH_3)(C_2H_4SO_3Na)$ " |

TABLE 4-continued

| Compound No. | $L^1 = L^3$ | $L^2 = L^4$ |
|---|---|---|
| SR-25 | " | $—N(C_2H_4OSO_3Na)(C_2H_4OSO_3Na)$ " |
| SR-26 | " | $—NHC^2H_4COONa$ |

In processing the present photographic materials, it is desirable that the concentration of the fluorescent brightening agent concentration in each processing solution be from 0.25 to 20 g/l, preferably from 0.5 to 10 g/l, when the processing solution is a-running solution; while, when the processing solution is a replenishing solution, the concentration be adjusted so as to maintain the concentration set for the running solution constant, specifically within the range of 0.25 to 30 g/l.

The brightening agents represented by the foregoing formula (II) can be synthesized according to known methods.

The combined use of the brightening agent of formula (II) and two or more other brightening agents is also beneficial to the present invention.

The other brightening agents usable in combination may be commercially available compounds. The commercial products thereof are listed in, e.g., *Dyeing Note,* 19th ed., pp. 165–168, Shikisen-sha. Of the products listed therein, Whitex RP and Whitex BRF liq. (trade names, products of Sumitomo Chemical Co., Ltd.) are favored over the others.

Although the exposed photographic materials can be subjected to conventional color photographic processing, it is desirable for the present color photographic materials to undergo bleach-fix processing after color development for the purpose of effecting rapid processing. In the case of using the aforementioned high silver chloride content emulsions, it is desirable in view of accelerating the desilvering that the pH of bleach-fix bath be adjusted to about 6.5 or lower, preferably about 6 or lower.

Examples of a development method applicable to the present photographic materials after exposure include a conventional development method using a developer containing an alkali agent and a developing agent, a wet development method wherein a developing agent is incorporated in the photographic material and an activator solution, e.g., a developing agent-free alkaline solution is employed for the development, and a heat development method using no processing solution. In particular, the activator method using a developing agent-free processing solution is preferred over the other methods, because it enables easy management and handling of the processing solution and reduction in waste disposal load to make for environmental preservation.

The suitable developing agents or their precursors incorporated in the photographic materials in the case of adopting the activator method include the hydrazine compounds described in, e.g., JP-A-8-234388, JP-A-9-152686, JP-A-9-152693, JP-A-9-211814 and JP-A-9-160193.

Further, the processing method in which the photographic material reduced in silver coverage undergoes the image amplification processing using hydrogen peroxide (intensification processing) is employed to advantage. In particular, it is favorable to apply this processing method to the activator method. Specifically, the image forming methods utilizing an activator solution containing hydrogen peroxide as disclosed in EP-A2-0730198 and JP-A-9-152695 are preferred.

Although the processing with an activator solution is generally followed by a desilvering step in the activator method, the desilvering step can be omitted in the case of applying the image amplification processing method to photographic materials having reduced silver coverage. In such a case, washing or stabilization processing can follow the processing with an activator solution to result in simplification of the processing process. On the other hand, when the system of reading the image information from photographic materials by means of a scanner or the like is employed, the processing form requiring no desilvering step can be applied even if the photographic materials are those having high silver coverage, such as picture-taking photographic materials.

The activator solution, desilvering solution (bleach/fix solution), washing solution and stabilizer used in the present invention can contain known ingredients and can be used in conventional manners. Preferably, those described in *Research Disclosure*, Item 36544, pp. 536–541 (September, 1994), and JP-A-8-234388 can be used in the present invention.

The antibacterial and antimold agents which can be used effectively in the present invention are those disclosed in JP-A-63-271247. As the hydrophilic colloid used for photographic layers to constitute the present photographic materials, gelatin is preferred. In particular, it is desirable for the gelatin used in the present invention that the content of heavy metals, such as Fe, Cu, Zn and Mn, as impurities therein be reduced to 5 ppm or below, preferably 3 ppm or below.

Now, the present invention will be illustrated in greater detail by reference to the following examples, which are not to be construed as limiting on or determinative of the scope of this invention.

EXAMPLE 1

Emulsions according to the present invention and comparative emulsions were prepared as follows:

Preparation of Emulsion A-01

Lime-processed gelatin (32 g) was added to 800 ml of distilled water, dissolved therein at 40° C., admixed with 3.3 g of sodium chloride and 0.02 g of N,N'-dimethylimidazolidine-2-thione, and then heated up to 60° C.

Thereto, a solution containing 10 g of silver nitrate in 30 ml of distilled water and a solution containing 3.5 g of sodium chloride in 30 ml of distilled water were added over a period of 7 minutes with stirring as the temperature was kept at 60° C. Further thereto were added a solution containing 206 g of silver nitrate in 600 ml of distilled water and a solution containing 73 g of sodium chloride in 600 ml of distilled water over a period of 45 minutes under the temperature of 60° C. Furthermore, the resulting solution was admixed with a solution containing 24 g of silver nitrate in 100 ml of distilled water and a solution containing 8.5 g of sodium chloride in 100 ml of distilled water over a period of 8 minutes. After cooling to 40° C., the resulting solution was desalted and washed using a sedimentation method, and dispersed again into 120 g of lime-processed gelatin. The dispersion obtained was admixed with a previously prepared fine grain silver bromide emulsion (having an average sphere equivalent diameter of 0.03 $\mu$m and containing $1\times10^{-7}$ mole of potassium hexachloroiridate (IV) per mole of finished silver halide), heated up to 60° C., and then subjected to gold-sulfur sensitization under the optimum condition. Then, the resulting emulsion was admixed with $4.2\times10^{-4}$ mole/mole Ag of a comparative Sensitizing dye A as illustrated hereinafter, $1.7\times10^{-4}$ mole/mole Ag of 1-phenyl-5-mercaptotetrazole and $1.7\times10^{-4}$ mole/mole Ag of 1-(5-methylureidophenyl)-5-mercaptotetrazole.

The thus prepared silver chloride emulsion was referred to as Emulsion A-01. According to the X-ray diffractiometry of Emulsion A-01, weak diffraction was observed in the portion corresponding to 10–40 mole % of silver silver bromide content.

Preparation of Emulsions A-02 and A-03

Emulsions were prepared in the same manner as Emulsion A-01, except that the comparative Sensitizing dye A was replaced by the following comparative Sensitizing dyes B and C respectively, and referred to as Emulsion A-02 and Emulsion A-03 respectively.

Sensitizing dye A

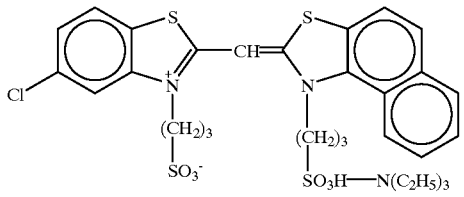

Sensitizing dye B

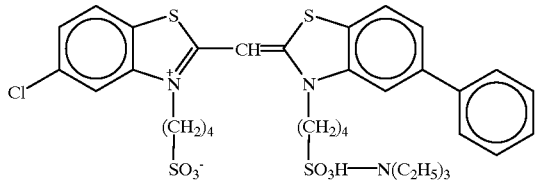

Sensitizing dye C

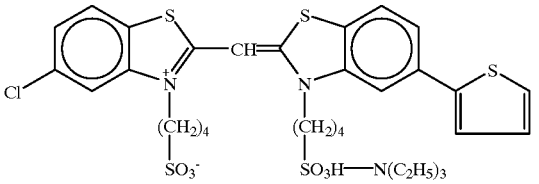

Preparation of Emulsions A-04 to A-06

Emulsions were prepared in the same manner as Emulsion A-01, except that the comparative Sensitizing dye A was replaced by the present Sensitizing dyes I-(1), I-(2) and I-(3) respectively, and referred to as Emulsions A-04, A-05 and A-06 respectively.

Preparation of Emulsions A-11 to A-16

An emulsion was prepared in the same manner as Emulsion A-01, except that 0.56 g of potassium iodide was added to the sodium chloride solution used at the third addition, and referred to as Emulsion A-11.

Other emulsions were prepared in the same manner as Emulsion A-11, except that the comparative Sensitizing dye A was replaced by the comparative Sensitizing dyes B and C respectively, and referred to as Emulsions A-12 and A-13 respectively.

Still other emulsions were prepared in the same manner as Emulsion A-11, except that the comparative Sensitizing dye A was replaced by the present Sensitizing dyes I-(1), I-(2) and I-(3) respectively, and referred to as Emulsions A-14, A-15 and A-16 respectively.

Each of Emulsions A-11 to A-16 comprised silver chloroiodobromide emulsion grains containing 0.2 mole % of silver iodide per mole of silver halide and having an silver iodide-containing phase (silver chloroiodide shell), wherein the average silver iodide content was 2 mole %, in the surface part situated outside the core part occupying about 90% of the volume of each grain.

Preparation of Emulsions A-24 to A-26

Emulsions were prepared in the same manners as Emulsions A-14 to A-16 respectively, except that 40 ml of an aqueous solution containing 0.56 g of potassium iodide was added over a period of 1 minute just before the third addition of aqueous solutions of silver nitrate and sodium chloride, and referred to as Emulsions A-24, A-25 and A-26 respectively.

Each of Emulsions A-24 to A-26 comprised silver chloroiodobromide emulsion grains containing 0.2 mole % of silver iodide per mole of silver halide and having a silver iodide-containing phase localized inside the grains (silver chloroiodide band). And these emulsion grains had an iodide-free layer outside the silver iodide-containing phase, and the thickness of the iodide-free layer was 0.03 $\mu$m.

Preparation of Emulsion B-01

In a reaction vessel, 1,200 ml of an aqueous gelatin solution (containing 20 g of deionized alkali-processed gelatin having a methionine content of about 40$\mu$ mole/g and 0.8 g of NaCl and showing pH 6.0) was placed, and kept at 60° C. Thereto, a solution Ag-1 (containing, per 100 ml, 20 g of silver nitrate, 0.8 g of the foregoing gelatin and 0.2 ml of 1N $HNO_3$) and a solution X-1 (containing, per 100 ml, 6.9 g of sodium chloride, 0.8 g of the foregoing gelatin and 0.3 ml of 1N NaOH) were added at a rate of 50 ml/min for a short period of 15 seconds in accordance with double jet method. After stirring for 2 minutes, a solution Ag-2 (containing, per 100 ml, 4 g of silver nitrate, 0.8 g of the foregoing gelatin and 0.2 ml of 1N $HNO_3$) and a solution X-2 (containing, per 100 ml, 2.8 g of potassium bromide, 0.8 g of the foregoing gelatin and 0.3 ml of 1N NaOH) were added thereto at a rate of 70 ml/min for a short period of 15 seconds in accordance with double jet method. After 2 minutes' stirring, the solution Ag-1 and the solution X-1 were further added at a rate of 25 ml/min for a period of 2 minutes in accordance with double jet method. Thereto, 15 ml of a NaCl solution (containing 10 g of sodium chloride per 100 ml) was added. The resulting solution was heated up to 55° C., and ripened for 5 minutes. Thereto, a solution Ag-3 (containing 20 g of silver nitrate per 100 ml) and a solution X-3 (containing 7 g of sodium chloride per 100 ml) were each added in an amount of 400 ml over a period of 30 minutes in accordance with double jet method.

Then, the resulting solution was washed by being admixed with a sedimenting agent and cooled to 30° C., and then admixed with an aqueous gelatin solution, thereby adjusted to pH 6.2 and pCl 13.0 at 38° C. The emulsion thus obtained was further admixed with a previously prepared fine grain silver bromide emulsion (having an average sphere equivalent diameter of 0.03 $\mu$m and containing $1\times10^{-7}$ mole of potassium hexachloroiridate (IV) per mole of finished silver halide), heated up to 60° C., and then subjected to gold-sulfur sensitization under the optimum condition. Then, the resulting emulsion was admixed with $7.9\times10^{-4}$ mole/mole Ag of the foregoing comparative Sensitizing dye A, $3.2\times10^{-4}$ mole/mole Ag of 1-phenyl-5-mercaptotetrazole and $3.2\times10^{-4}$ mole/mole Ag of 1-(5-methylureidophenyl)-5-mercaptotetrazole. Additionally, the amounts of these compounds admixed were adjusted so that the thus prepared Emulsion B-01 and the foregoing Emulsion A-01 were almost equal in amounts of the compounds added per surface area of silver halide grain.

The thus prepared Emulsion B-01 was a silver chloride emulsion, and the X-ray diffractiometry thereof showed weak diffraction in the portion corresponding to 10–40 mole % of silver silver bromide content.

Preparation of Emulsions B-03 to B-06

Another emulsion was prepared in the same manner as Emulsion B-01, except that the comparative Sensitizing dye A was replaced by the comparative Sensitizing dyes C, and referred to as Emulsion B-03. Other emulsions were prepared in the same manner as Emulsion B-01, except that the comparative Sensitizing dye A was replaced by the present Sensitizing dyes I-(l), I-(2) and I-(3) respectively, and referred to as Emulsions B-04, B-05 and B-06 respectively.

Preparation of Emulsion B-11 and Emulsions B-13 to B-16

An emulsion was prepared in the same manner as Emulsion B-01, except that after adding 350 ml of the solution Ag-3 and 350 ml of the solution X-3, the solution X-3 was replaced by a solution X-4 (containing 7 g of sodium chloride and 0.39 g of potassium iodide per 100 ml), and successively thereto 50 ml of the solution Ag-3 and 50 ml of the solution X-4 were added. The thus prepared emulsion was referred to as Emulsion B-11.

Another emulsion was prepared in the same manner as Emulsion B-11, except that the comparative Sensitizing dye A was replaced by the comparative Sensitizing dyes C, and referred to as Emulsion B-13. Other emulsions were prepared in the same manner as Emulsion B-11, except that the comparative Sensitizing dye A was replaced by the present Sensitizing dyes I-(1), I-(2) and I-(3) respectively, and referred to as Emulsions B-14, B-15 and B-16 respectively.

Each of Emulsions B-11, B-13, B-14, B-15 and B-16 comprised silver chloroiodobromide emulsion grains containing 0.2 mole % of silver iodide per mole of silver halide and having an silver iodide-containing phase (silver chloroiodide shell), wherein the average silver iodide content was 2 mole %, in the surface part situated outside the core part occupying about 90% of the volume of each grain.

Preparation of Emulsions B-24 to B-26

Emulsions were prepared in the same manners as Emulsions B-14 to B-16 respectively, except that after adding 350 ml of the solution Ag-3 and 350 ml of the solution X-3, 50 ml of an aqueous KI solution (containing 0.19 g of potassium iodide) was added, and then the solution X-3 was replaced by a solution X-4 (containing 7 g of sodium chloride and 0.39 g of potassium iodide per 100 ml), and then 50 ml of the solution Ag-3 and 50 ml of the solution X-3 were added without replacing the solution X-3 by the solution X-4, and referred to as Emulsions B-24, B-25 and B-26 respectively.

Each of Emulsions B-24 to B-26 comprised silver chloroiodobromide emulsion grains containing 0.2 mole % of silver iodide per mole of silver halide and having a silver iodide-containing phase localized inside the grains (silver chloroiodide band). And these emulsion grains had an iodide-free layer outside the silver iodide-containing phase, and the thickness of the iodide-free layer was 0.007 μm.

The grain shape, grain size and grain size distribution of each of the thus prepared emulsions were determined with photographs taken through an electron microscope. Herein, the grain size refers to the diameter of the circle having the same area as the projected area of the grain, and the number average is taken in expressing the grain size, and the grain size distribution is represented by the value obtained by dividing the standard deviation of grain diameters by the average grain size.

The Emulsions A-01 to A-06, the Emulsions A-11 to A-16 and the Emulsions A-24 to A-26 were almost equal in grain size and grain size distribution, and their grain size was 0.88 μm and their grain size distribution was 0.09.

With respect to the grain shape, although each of these Emulsions comprised isotropic grains surrounded mainly by (100) surfaces, each of the Emulsions A-01 to A-06 had a cubic grain shape substantially made up of (100) surfaces but having somewhat round corners (the percentage of surfaces of Miller indices other than (100) was less than 4%), each of the Emulsions A-11 to A-16 had a cubic grain shape made up of (100) surfaces in a substantial sense and having angular corners (the percentage of surfaces of Miller indices other than (100) was less than 1%), and each of the Emulsions A-24 to A-26 had a dodecahedral grain shape rounded off the angles and having (111) surfaces at the corners (the percentage of surfaces of Miller indices other than (100) was about 9%).

On the other hand, the Emulsions B-01 and B-03 to B-06, the Emulsions B-11 and B-13 to B-16, and the Emulsions B-24 to B-26 were almost equal in grain size and grain size distribution, and their grain size was 0.63 μm and their grain size distribution was 0.28.

With respect to the grain shape, although each of these Emulsions comprised tabular grains surrounded mainly by (100) surfaces, each of the Emulsions B-01 and B-03 to B-06 had a tabular grain shape having somewhat round corners (the percentage of surfaces of Miller indices other than (100) was less than 4%), each of the Emulsions B-11 and B-13 to B-16 had a tabular grain shape made up of (100) surfaces in a substantial sense and having angular corners (the percentage of surfaces of Miller indices other than (100) was less than 1%), and each of the Emulsions B-24 to B-26 had a tabular grain shape rounded off the angles and having (111) surfaces at the corners (the percentage of surfaces of Miller indices other than (100) was about 7%). In every Emulsion, the proportion of tabular grains having (100) major surfaces and an aspect ratio of at least 2 to the total emulsion grains was 80% on a projected area basis, the average projected area diameter of the tabular grains was 1.07 μm, and the average aspect ration was 7.3.

The grain shapes of these emulsions, the positions at which their silver iodide-containing phases are present, and species of spectral sensitizing dyes used therein are summarized in Table 5.

TABLE 5

| Emulsion | Grain shape | Surfaces other than (100) | Iodide-containing phase | Spectral sensitizing dye |
|---|---|---|---|---|
| A-01 | cubic | absent | absent | A |
| A-02 | " | " | " | B |
| A-03 | " | " | " | C |
| A-04 | " | " | " | I-(1) |
| A-05 | " | " | " | I-(2) |
| A-06 | " | " | " | I-(3) |
| A-11 | " | " | present (surface layer) | A |
| A-12 | " | " | present (surface layer) | B |
| A-13 | " | " | present (surface layer) | C |
| A-14 | " | " | present (surface layer) | I-(1) |
| A-15 | " | " | present (surface layer) | I-(2) |
| A-16 | " | " | present (surface layer) | I-(3) |
| A-24 | dodecahedral | present | present (inside) | I-(1) |

TABLE 5-continued

| Emulsion | Grain shape | Surfaces other than (100) | Iodide-containing phase | Spectral sensitizing dye |
|---|---|---|---|---|
| A-25 | " | " | present (inside) | I-(2) |
| A-26 | " | " | present (inside) | I-(3) |
| B-01 | tabular | absent | absent | A |
| B-03 | " | " | " | C |
| B-04 | " | " | " | I-(1) |
| B-05 | " | " | " | I-(2) |
| B-06 | " | " | " | I-(3) |
| B-11 | " | " | present (surface layer) | A |
| B-13 | " | " | present (surface layer) | C |
| B-14 | " | " | present (surface layer) | I-(1) |
| B-15 | " | " | present (surface layer) | I-(2) |
| B-16 | " | " | present (surface layer) | I-(3) |
| B-24 | " | present | present (inside) | I-(1) |
| B-25 | " | " | present (inside) | I-(2) |
| B-26 | " | " | present (inside) | I-(3) |

The surface of a paper support laminated with polyethylene on both sides was subjected to a corona discharge operation, provided with a gelatin undercoat containing sodium dodecylbenzenesulfonate, and further coated with various photographic constituent layers to prepare a multilayer color photographic paper having the following layer structure (Sample No. 101). Coating compositions used were prepared in the manner described below.

Preparation of Coating Solution for First Layer

A yellow coupler (ExY) (153.0 g), 15.0 g of a color image stabilizer (Cpd-1), 7.5 g of a color image stabilizer (Cpd-2) and 16.0 g of a color image stabilizer (Cpd-3) were dissolved in a mixed solvent consisting of 180.0 ml of ethyl acetate, 25 g of a solvent (Solv-1) and 25 g of a solvent (Solv-2), and then dispersed in an emulsified condition into 1,000 ml of a 10% aqueous gelatin solution containing 60 ml of a 10% solution of sodium dodecylbenzenesulfonate and 10 g of citric acid to prepare an emulsified Dispersion A.

This emulsified Dispersion A was mixed homogeneously with the silver chloride Emulsion A-01, and thereto were added other ingredients described below so as to obtain the coating solution for the first layer having the following composition.

Coating solutions for from the second to seventh layers were prepared respectively in the same manner as that for the first layer. In each layer, sodium salt of 1-hydroxy-3,5-dichloro-s-triazine was used as gelatin hardener. In addition, Ab-1, Ab-2, Ab-3 and Ab-4 were added to all layers so as to have the total coverage rates of 15.0 mg/m$^2$, 60.0 mg/m$^2$, 5.0 mg/m$^2$ and 10.0 mg/m$^2$, respectively.

(Ab-1) Antiseptic

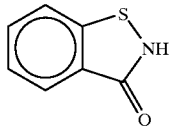

(Ab-2) Antiseptic

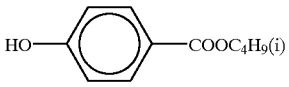

(Ab-3) Antiseptic

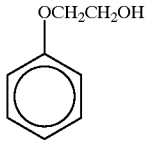

(Ab-4) Antiseptic

1:1:1:1 mixture of a, b, c and d

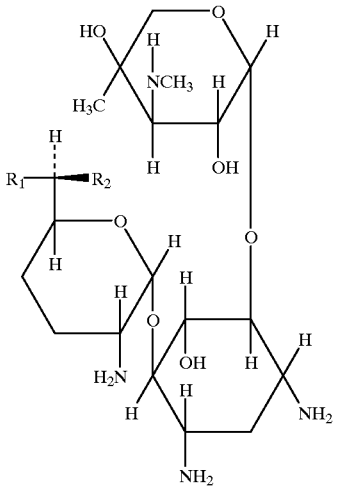

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

Spectral sensitizing dyes illustrated below were added to the silver chlorobromide emulsions for each light-sensitive emulsion layer.

Green-sensitive Emulsion Layer

Sensitizing Dye D

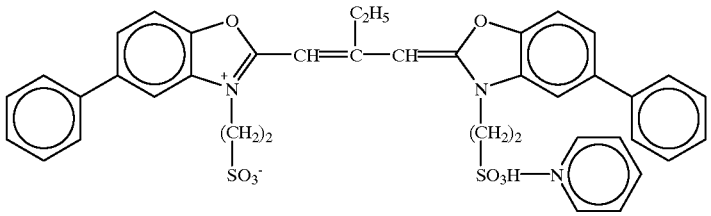

Sensitizing Dye E

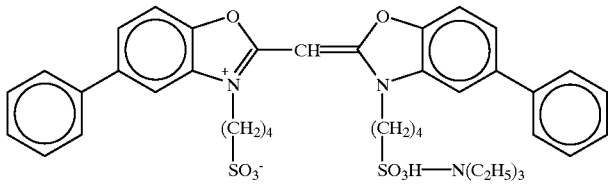

Sensitizing Dye F

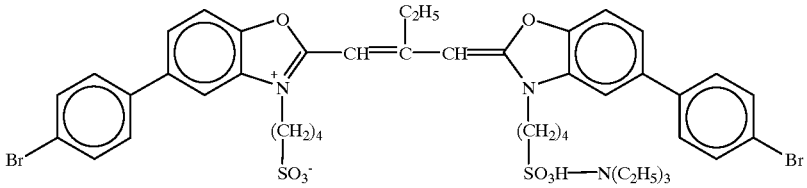

(Sensitizing Dye D illustrated above was added to the large-sized emulsion in the amount of $3.0\times10^{-4}$ mole per mole silver halide, and to the small-sized emulsion in the amount of $3.6\times10^{-4}$ mole per mole of silver halide; Sensitizing Dye E illustrated above was added to the large-sized emulsion in the amount of $4.0\times10^{-5}$ mole per mole silver halide, and to the small-sized emulsion in the amount of $7.0\times10^{-5}$ mole per mole of silver halide; and Sensitizing Dye F illustrated above was added to the large-sized emulsion in the amount of $2.0\times10^{-4}$ mole per mole silver halide, and to the small-sized emulsion in the amount of $2.8\times10^{-4}$ mole per mole of silver halide.)

Red-sensitive Emulsion Layer

Sensitizing Dye G

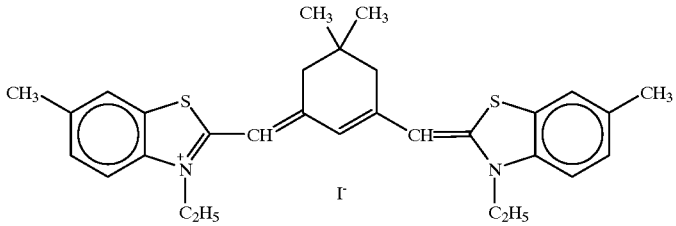

Sensitizing Dye H

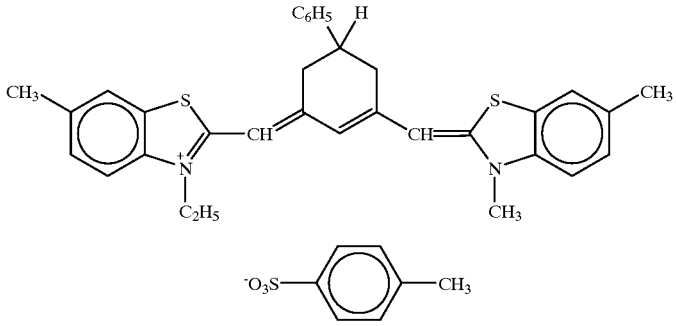

(Sensitizing Dyes G and H illustrated above were added to the large-sized emulsion in the same amount of $6.0\times10^{-5}$ mole per mole silver halide, and to the small-sized emulsion in the same amount of $9.0\times10^{-5}$ mole per mole silver halide.)

Further the following Compound I was added in the amount of $2.6\times10^{-3}$ mole per mole of silver halide:

Compound I

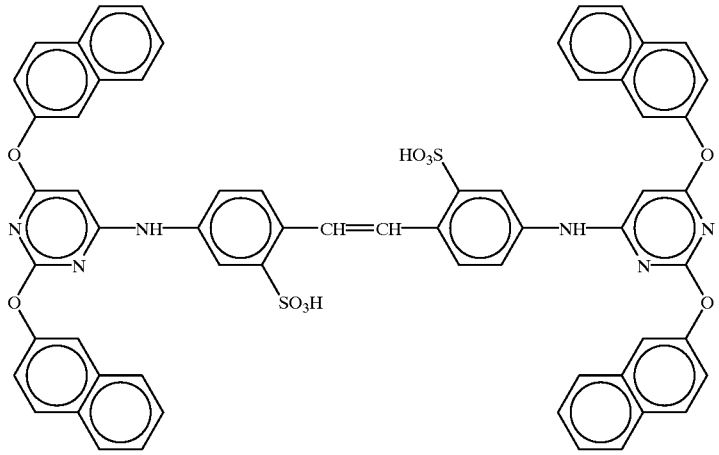

Moreover, 1-(3-methylureidophenyl)-5-mercaptotetrazole was added to the blue-sensitive emulsion layer, the green-sensitive emulsion layer and the red-sensitive emulsion layer in the amounts of $3.3\times10^{31\ 4}$ mole, $1.0\times10^{-3}$ mole and $5.9\times10^{-4}$ mole, respectively, per mole of silver halide, and further added to the second layer, the fourth layer, the sixth layer and the seventh layer at the coverage rates of 0.2 mg/m$^2$, 0.2 mg/m$^2$, 0.6 mg/m$^2$ and 0.1 mg/m$^2$ respectively.

Furthermore, 4-hydroxy-6-methyl-1,3,3a,7-tetraazaindene was added to the blue-sensitive emulsion layer and the green-sensitive emulsion layer in the amounts of $1\times10^{-4}$ mole and $2\times10^{-4}$ mole, respectively, per mole of silver halide.

To the red-sensitive emulsion layer, a methacrylic acid-butyl acrylate (1:1 by weight) copolymer (average molecular weight: 200,000–400,000) was also added at the coverage rate of 0.05 g/m$^2$.

To the second layer, the fourth layer and the sixth layer, disodium catechol-3,5-disulfonate was also added at the coverage rates of 6 mg/m$^2$, 6 mg/m$^2$ and 18 mg/m$^2$ respectively.

In addition, the dyes illustrated below (their respective coverage rates are designated in parentheses) were added to each emulsion layer in order to inhibit an irradiation phenomenon from occurring.

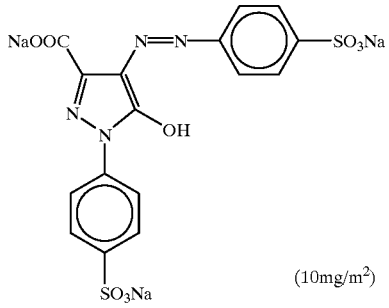

(10mg/m$^2$)

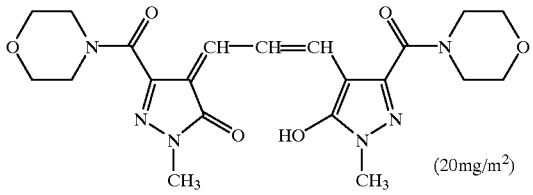

(20mg/m$^2$)

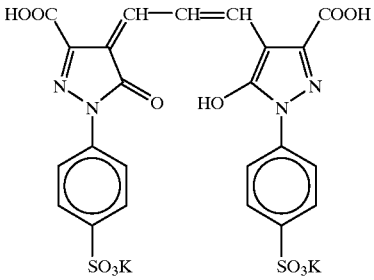

(5mg/m$^2$)

-continued

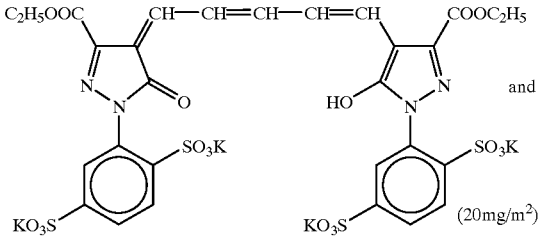

and

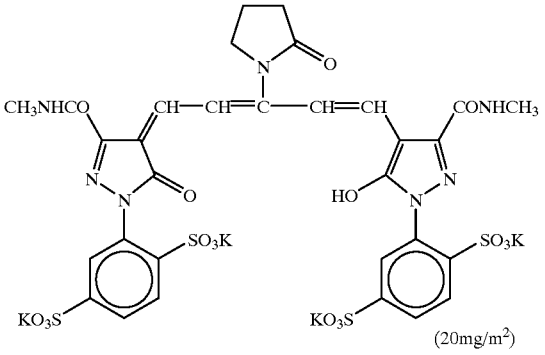

Layer Structure

The composition of each constituent layer was described below. Each figure on the right side designates a coverage rate (g/m$^2$) of the ingredient corresponding thereto. As for the silver halide emulsion, the figure represents the coverage rate based on silver halide.

Support

Polyethylene-laminated paper which contained a white pigment ($TiO_2$: 16 weight % in proportion, ZnO: 4 weight % in proportion), a brightening agent (8:2 mixture of 4,4'-bis(benzoxazolyl)stilbene and 4,4'-bis(5-methylbenzoxazolyl) stilbene: 0.05 weight % in proportion) and a bluish dye (ultramarine) in the polyethylene laminate on the side of the first layer.

| | |
|---|---|
| First layer (blue-sensitive emulsion layer): | |
| The foregoing silver chloride Emulsion A-01 | 0.27 |
| Gelatin | 1.36 |
| Yellow coupler (ExY) | 0.79 |
| Color image stabilizer (Cpd-1) | 0.08 |
| Color image stabilizer (Cpd-2) | 0.04 |
| Color image stabilizer (Cpd-3) | 0.08 |
| Solvent (Solv-1) | 0.13 |
| Solvent (Solv-2) | 0.13 |
| Second layer (color stain inhibiting layer): | |
| Gelatin | 0.99 |
| Color stain inhibitor (Cpd-4) | 0.09 |
| Color image stabilizer (Cpd-5) | 0.018 |
| Color image stabilizer (Cpd-6) | 0.13 |
| Color image stabilizer (Cpd-7) | 0.01 |
| Solvent (Solv-1) | 0.06 |
| Solvent (Solv-2) | 0.22 |
| Third layer (green-sensitive emulsion layer): | |
| Silver chlorobromide Emulsion B (having a cubic crystal form, and being a 1:3 (based on Ag) mixture of a large-sized Emulsion B having an average grain size of 0.45 μm and a variation coefficient of 0.10 with respect to grain size distribution with a small-sized emulsion B having an average grain size of 0.35 μm and a variation coefficient of 0.08 with respect to grain size distribution, which each contained AgCl as the grain substrate and 0.4 mol % of AgBr localized in part of the grain surface) | 0.14 |
| Gelatin | 1.36 |
| Magenta coupler (ExM) | 0.15 |
| Ultraviolet absorbent (UV-1) | 0.05 |
| Ultraviolet absorbent (UV-2) | 0.03 |
| Ultraviolet absorbent (UV-3) | 0.02 |
| Ultraviolet absorbent (UV-4) | 0.04 |
| Color image stabilizer (Cpd-2) | 0.02 |
| Color image stabilizer (Cpd-4) | 0.002 |
| Color image stabilizer (Cpd-6) | 0.09 |
| Color image stabilizer (Cpd-8) | 0.02 |
| Color image stabilizer (Cpd-9) | 0.03 |
| Color image stabilizer (Cpd-10) | 0.01 |
| Color image stabilizer (Cpd-11) | 0.0001 |
| Solvent (Solv-3) | 0.11 |
| Solvent (Solv-4) | 0.22 |
| Solvent (Solv-5) | 0.20 |
| Fourth layer (color stain inhibiting layer): | |
| Gelatin | 0.71 |
| Color stain inhibitor (Cpd-4) | 0.06 |
| Color image stabilizer (Cpd-5) | 0.013 |
| Color image stabilizer (Cpd-6) | 0.10 |
| Color image stabilizer (Cpd-7) | 0.007 |
| Solvent (Solv-1) | 0.04 |
| Solvent (Solv-2) | 0.16 |
| Fifth layer (red-sensitive emulsion layer): | |
| Silver chlorobromide Emulsion C (having a cubic crystal form, and being a 1:4 (based on Ag) mixture of a large-sized Emulsion C having an average grain size of 0.50 μm and a variation coefficient of 0.09 with respect to grain size distribution with a small-sized emulsion C having an average grain size of 0.41 μm and a variation coefficient of 0.11 with respect to grain size distribution, which each contained AgCl as the grain substrate and 0.5 mol % of AgBr localized in part of the grain surface) | 0.20 |
| Gelatin | 1.11 |
| Cyan coupler (ExC-1) | 0.30 |
| Ultraviolet absorbent (UV-1) | 0.14 |
| Ultraviolet absorbent (UV-2) | 0.05 |
| Ultraviolet absorbent (UV-3) | 0.04 |
| Ultraviolet absorbent (UV-4) | 0.06 |
| Color image stabilizer (Cpd-1) | 0.25 |
| Color image stabilizer (Cpd-9) | 0.01 |
| Color image stabilizer (Cpd-10) | 0.01 |
| Color image stabilizer (Cpd-12) | 0.02 |
| Solvent (Solv-6) | 0.23 |
| Sixth layer (ultraviolet absorbing layer): | |
| Gelatin | 0.66 |
| Ultraviolet absorbent (UV-1) | 0.19 |
| Ultraviolet absorbent (UV-2) | 0.06 |
| Ultraviolet absorbent (UV-3) | 0.06 |
| Ultraviolet absorbent (UV-4) | 0.05 |
| Ultraviolet absorbent (UV-5) | 0.09 |
| Solvent (Solv-7) | 0.25 |
| Seventh layer (protective layer): | |
| Gelatin | 1.00 |
| Acryl-modified polyvinyl alcohol (modification degree: 17%) | 0.04 |
| Liquid paraffin | 0.02 |
| Surfactant (Cpd-13) | 0.01 |

The structural formulae of the compounds used herein are illustrated below:

(ExY) Yellow Coupler

60:40 mixture of (1) and (2):

(1)
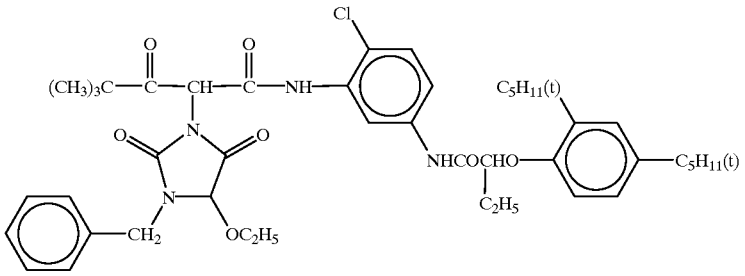
(2)
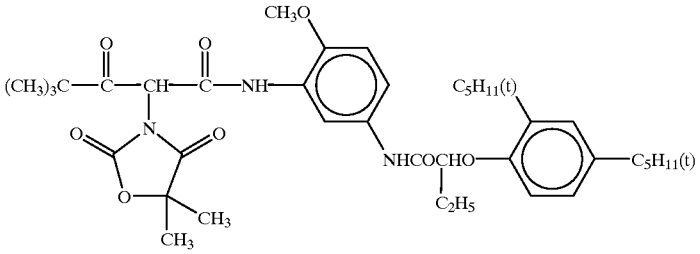
(ExM) Magenta Coupler
60:40 mixture of (1) and (2):
(1)
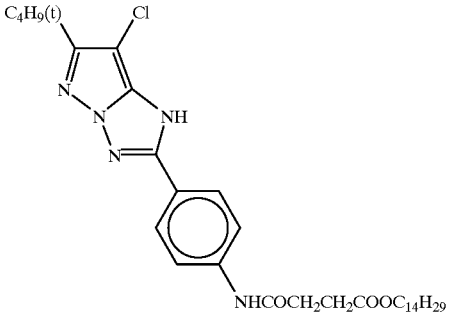
(2)
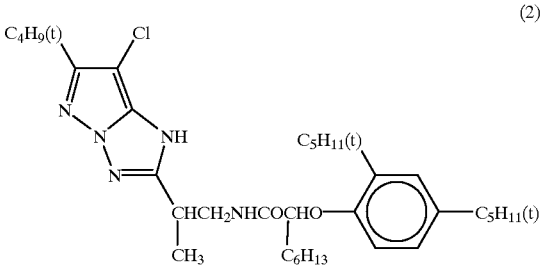

(ExC-1) Cyan Coupler
15:85 mixture of (1) and (2):
(1)
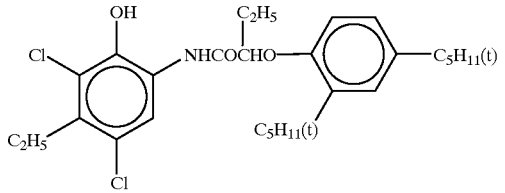
(2)
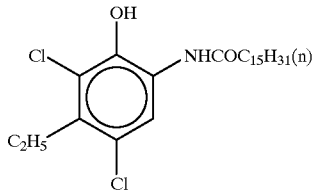
(Cpd-1) Color Image Stabilizer
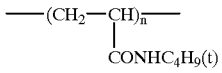
number average molecular
weight: 60,000
(Cpd-2) Color Image Stabilizer
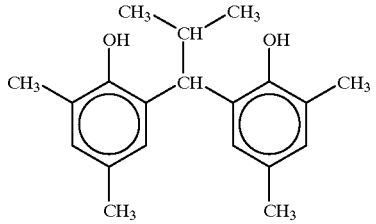
(Cpd-3) Color Image Stabilizer
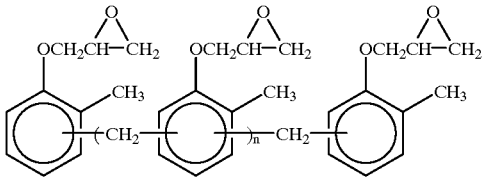
n = 7–8 (on average)
(Cpd-4) Color stain inhibitor
1:1:1 mixture of (1), (2) and (3):
(1)
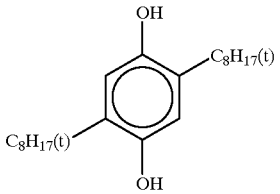
(2)
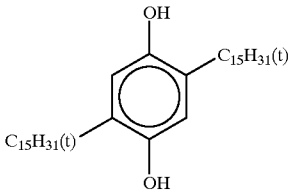

-continued
(3)
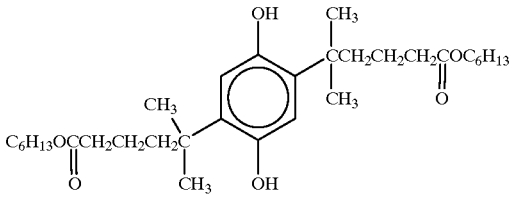
(Cpd-5) Color image stabilizer
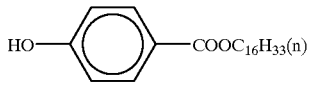
(Cpd-6) Color image stabilizer
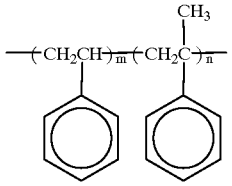
number average molecular weight: 600
m/n = 10/90
(Cpd-7) Color image stabilizer
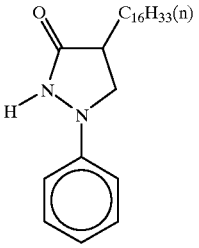
(Cpd-8) Color image stabilizer
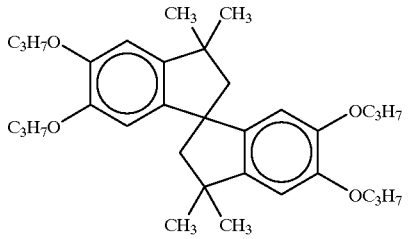
(Cpd-9) Color Image Stabilizer
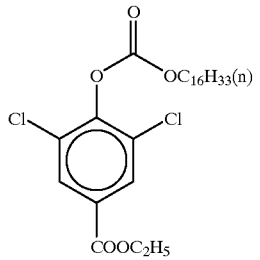

-continued
(Cpd-10) Color Image Stabilizer
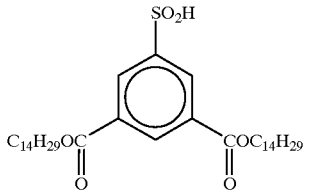
(Cpd-11) Color image stabilizer
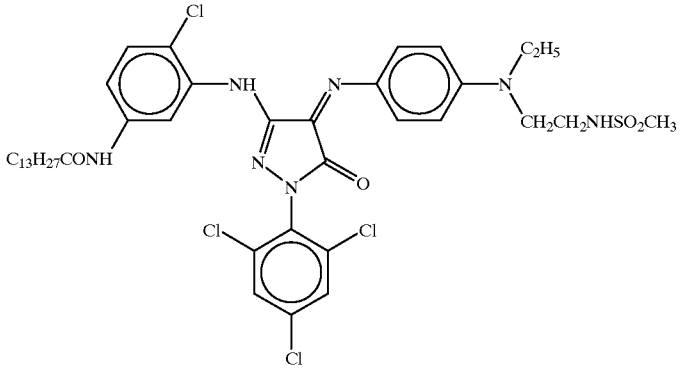
(Cpd-12) Color image stabilizer
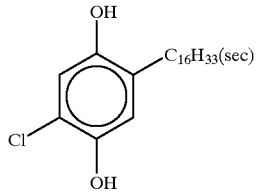
(Cpd-13) Surfactant
7:3 mixture of
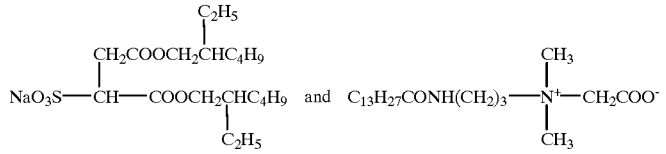
(UV-1) Ultraviolet absorbent
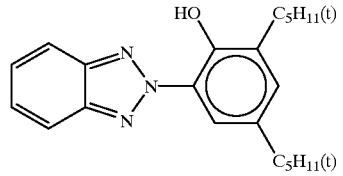
(UV-2) Ultraviolet absorbent
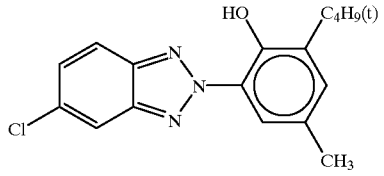

-continued
(UV-3) Ultraviolet absorbent
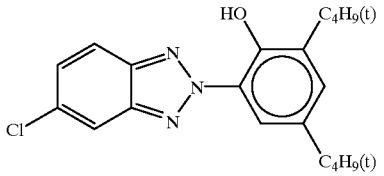
(UV-4) Ultraviolet absorbent
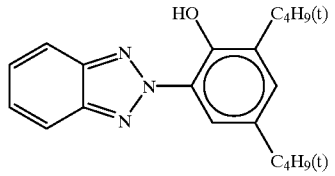
(UV-5) Ultraviolet absorbent
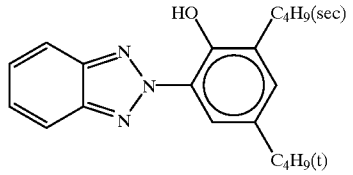
(Solv-1) Solvent
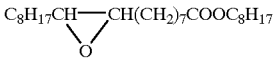
(Solv-2) Solvent
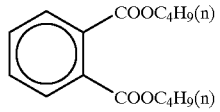
(Solv-3) Solvent
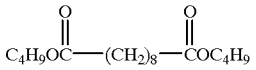
(Solv-4) Solvent
(Solv-5) Solvent
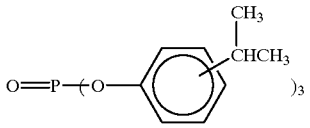
(Solv-6) Solvent
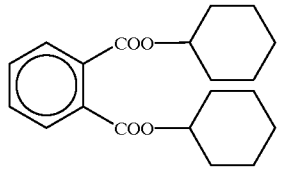

-continued (Solv-7) Solvent

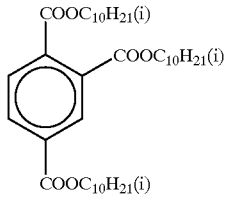

Sample Nos. 102 to 128 were prepared in the same manner as Sample No. 101, except that the emulsion of the blue-sensitive emulsion layer was changed to the emulsions shown in Table 6 respectively.

In accordance with the procedure described below, each of Sample Nos. 101 to 128 was examined for sensitivity just after coating, which is denoted by $S_0$, and sensitivity after 3-day storage under the condition of 50° C. and 80% RH, which is denoted by S. The difference between these two sensitivities, $S_0-S$, is denoted by ΔS, and the experimental results thereof are shown in Table 6.

The term "sensitivity" as used herein refers to the reciprocal of an exposure amount required for providing the density of fog+0.6, and shown as relative value.

Each of Sample Nos. 101 to 128 was subjected to gradation exposure for sensitometry using a sensitometer (Model FWH, produced by Fuji Photo Film Co., Ltd., equipped with a light source having a color temperature of 3,200° K.) via a blue filter under the condition that the exposure amount was 250 CMS and the exposure time was 1/10 second, and then to the following photographic processing (Processing A). Further, the developed color densities of the processed Sample were measured to achieve the sensitometry.

Processing Process

Processing A

| Processing Step | Temperature | Time | Amount* replenished | Tank Volume |
|---|---|---|---|---|
| Color development | 35° C. | 45 sec. | 125 ml | 2 l |
| Bleach-fix | 30–35° C. | 45 sec. | 215 ml | 2 l |
| Rinsing | 30° C. | 18 sec. | 90 ml | 1 l |
| Drying | 70–80° C. | 40 sec. | | |

*per $m^2$ of photographic material.

The composition of each processing solution used is described below.

Color Developer

| | Tank Solution | Replenisher |
|---|---|---|
| Water | 800 ml | 800 ml |
| Ethylenediamine-N,N,N',N'-tetra-methylenephosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-Ethyl-N-(â-methanesulfonamido-ethyl)-3-methyl-4-aminoaniline sulfate | 5.0 g | 7.0 g |
| N,N-Bis(carboxymethyl)hydrazine | 4.0 g | 5.0 g |

-continued

| | Tank Solution | Replenisher |
|---|---|---|
| Monosodium N,N-di(sulfoethyl)-hydroxylamine | 4.0 g | 5.0 g |
| Brightening agent SR-12 | 1.0 g | 2.0 g |
| Water to make | 1,000 ml | 1,000 ml |
| pH (25° C.) adjusted to | 10.05 | 10.45 |

Bleach-Fix Bath

Tank solution=Replenisher

| | |
|---|---|
| Water | 400 ml |
| Ammonium thiosulfate (700 g/l) | 100 ml |
| Sodium sulfite | 17 g |
| Ammonium ethylenediaminetetra-acetatoferrate (III) | 55 g |
| Disodium ethylenediaminetetraacetate | 5 g |
| Ammonium bromide | 40 g |
| Water to make | 1,000 ml |
| pH (25° C.) adjusted to | 6.0 |

Rinsing Bath

Tank solution=Replenisher

Ion exchange water (in which calcium and magnesium ion concentrations were each below 3 ppm).

With respect to the blue-sensitive dyes remaining in Sample Nos. 101 to 128 respectively after photographic processing, a comparison of their extents was made in the following manner: Each unexposed sample of a fixed size is processed in accordance with the foregoing processing process, and then soaked in a water-methanol (1:1) mixture of about 40° C. for 10 minutes with stirring, thereby extracting the dye remaining in the sample. The spectral absorption spectrum of the thus obtained extract was measured with a spectrophotometer, and the absorbance is integrated between the wavelengths of 350 nm and 480 nm corresponding to the absorption wavelength region of the blue-sensitive dyes used. In addition to the aforementioned Processing A, the remaining extents of dyes were examined in the case of adopting the following Processing B as well. The integration values of the absorbance arising from the residual dyes are shown in Table 6 as relative values, with Sample No. 101 in the case of Processing A being taken as 100.

Processing Process

Processing B

The compositions of processing solutions used were the same as those used in Processing A respectively.

| Processing Step | Temperature | Time | Amount* replenished | Tank Volume |
|---|---|---|---|---|
| Color development | 40° C. | 28 sec. | 125 ml | 2 l |
| Bleach-fix | 40° C. | 28 sec. | 215 ml | 2 l |
| Rinsing | 40° C. | 18 sec. | 90 ml | 1 l |
| Drying | 70–80° C. | 60 sec. | | |

*per $m^2$ of photographic material.

TABLE 6

| Sample No. | Emulsion used | Dye used | ΔS | Residual dye Processing A | Residual dye Processing B | Note |
|---|---|---|---|---|---|---|
| 101 | A-01 | A | −0.08 | 100 | 180 | comparison |
| 102 | A-02 | B | −0.10 | 76 | 128 | " |
| 103 | A-03 | C | −0.11 | 80 | 138 | " |
| 104 | A-04 | I-(1) | −0.30 | 14 | 25 | " |
| 105 | A-05 | I-(2) | −0.27 | 18 | 27 | " |
| 106 | A-06 | I-(3) | −0.28 | 21 | 30 | " |
| 107 | A-11 | A | −0.07 | 105 | 191 | " |
| 108 | A-12 | B | −0.08 | 75 | 138 | " |
| 109 | A-13 | C | −0.08 | 83 | 139 | " |
| 110 | A-14 | I-(1) | −0.10 | 15 | 22 | invention |
| 111 | A-15 | I-(2) | −0.09 | 20 | 35 | " |
| 112 | A-16 | I-(3) | −0.09 | 22 | 31 | " |
| 113 | A-24 | I-(1) | −0.25 | 17 | 29 | comparison |
| 114 | A-25 | I-(2) | −0.25 | 19 | 33 | " |
| 115 | A-26 | I-(3) | −0.24 | 22 | 33 | " |
| 116 | B-01 | A | −0.12 | 180 | 330 | " |
| 117 | B-03 | C | −0.13 | 140 | 256 | " |
| 118 | B-04 | I-(1) | −0.33 | 30 | 47 | " |
| 119 | B-05 | I-(2) | −0.30 | 35 | 52 | " |
| 120 | B-06 | I-(3) | −0.32 | 36 | 45 | " |
| 121 | B-11 | A | −0.10 | 177 | 341 | " |
| 122 | B-13 | C | −0.10 | 147 | 263 | " |
| 123 | B-14 | I-(1) | −0.10 | 29 | 47 | invention |
| 124 | B-15 | I-(2) | −0.09 | 32 | 45 | " |
| 125 | B-16 | I-(3) | −0.11 | 33 | 46 | " |
| 126 | B-24 | I-(1) | −0.22 | 33 | 49 | comparison |
| 127 | B-25 | I-(2) | −0.21 | 36 | 48 | " |
| 128 | B-26 | I-(3) | −0.21 | 36 | 52 | " |

As mentioned below in detail, the advantages of the present invention are apparent from the data shown in Table 6.

Making a comparison between a sample using the Comparative Dye B or C disclosed in JP-A-7-5614 as spectral sensitizing dye in the blue-sensitive emulsion and a sample using the Comparative Dye A in the blue-sensitive emulsion (comparison between Sample Nos. 101 and 102 or 103, comparison between Sample Nos. 107 and 108 or 109, comparison between Sample Nos. 116 and 117, or comparison between Sample Nos. 121 and 122), the residual dye in the former sample was reduced in extent, compared with that in the latter sample. However, the extent of reduction is still insufficient even in the samples using the Comparative Dyes B or C. In particular, the residual dye problem was serious in the cases of Processing B which was short in processing time relative to Processing A and the cases of using tabular grain emulsions which were increased in amount of dye used. In the samples using the present spectral sensitizing dyes I-(1), I-(2) and I-(3), on the other hand, the remaining extent of these dyes each was appreciably reduced. However, the samples using the high silver chloride content emulsion having no silver iodide-containing phase encountered a problem that the sensitivity drop upon storage was caused by the use of the present spectral sensitizing dyes (Sample Nos. 104 to 106 and Sample Nos. 118 to 120). On the other hand, in the samples using the present silver halide emulsions having the silver iodide-containing phase at the grain surface, the sensitivity drop upon storage due to the use of the present spectral sensitizing dye was reduced in extent; as a result, the present silver halide emulsion has proved to be effective for improving the keeping quality (Sample Nos. 110 to 112 and Sample Nos. 123 to 125). In these samples, the remaining extents of spectral sensitizing dyes were also on the satisfactorily low level. However, such a keeping quality improving effect was not observed in the cases of using the silver halide emulsions having the silver iodide-containing phase inside the grains (Sample Nos. 113 to 115 and Sample Nos. 126 to 128). Thus, the embodiments of present invention has proved to be advantageous over the other embodiments.

EXAMPLE 2

Emulsions C-04 to C-07 were prepared in the same manner as the Emulsion A-04 of Example 1, except that the present spectral sensitizing dye I-(1) was replaced by the present spectral sensitizing dyes I-(4), I-(5), I-(6) and I-(7) respectively. Further, Emulsions C-14 to C-17 were prepared in the same manner as the Emulsion A-14 of Example 1, except that the present spectral sensitizing dye I-(1) was replaced by the present spectral sensitizing dyes I-(4), I-(5), I-(6) and I-(7) respectively.

Sample No. 129 was prepared in the same manner as Sample No. 101 of Example 1, except that the contents of the fifth layer were changed as described below. Further, Sample Nos. 130 to 139 were prepared in the same manner as Sample No. 129, except that the Emulsion A-01 was replaced by the Emulsions A-04, C-04, C-05, C-06, C-07, A-14, C-14, C-15, C-16 and C-17 respectively.

| Fifth Layer (red-sensitive emulsion layer): | |
|---|---|
| Silver chlorobromide Emulsion C (having a cubic crystal form, and being a 1:4 (based on Ag) mixture of a large-sized Emulsion C having an average grain size of 0.50 μm and a variation coefficient of 0.09 with respect to grain size distribution with a small-sized emulsion C having an average grain size of 0.41 μm and a variation coefficient of 0.11 with respect to grain size distribution, which each contained AgCl as the grain substrate and 0.8 mol % of AgBr localized in part of the grain surface) | 0.12 |
| Gelatin | 1.11 |
| Cyan coupler (ExC-2) | 0.13 |
| Cyan coupler (ExC-3) | 0.03 |
| Color image stabilizer (Cpd-1) | 0.05 |
| Color image stabilizer (Cpd-6) | 0.05 |
| Color image stabilizer (Cpd-7) | 0.02 |
| Color image stabilizer (Cpd-9) | 0.04 |
| Color image stabilizer (Cpd-10) | 0.01 |
| Color image stabilizer (Cpd-14) | 0.01 |
| Color image stabilizer (Cpd-15) | 0.06 |
| Color image stabilizer (Cpd-16) | 0.09 |
| Color image stabilizer (Cpd-17) | 0.09 |

-continued
| | |
|---|---|
| Color image stabilizer (Cpd-18) | 0.01 |
| Solvent (Solv-5) | 0.15 |
| Solvent (Solv-8) | 0.05 |
| Solvent (Solv-9) | 0.10 |
The structural formulae of the compounds used herein, other than those used in Example 1, are illustrated below:
(ExC-2) Cyan coupler
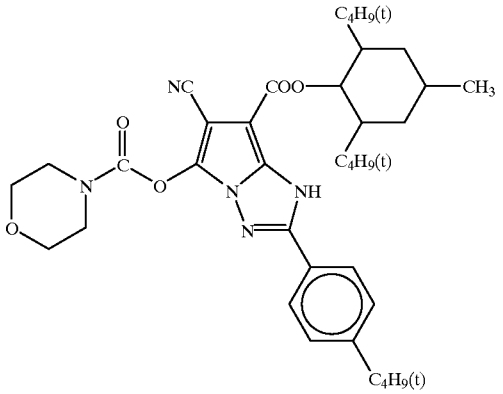
(ExC-3) Cyan coupler
50:25:25 Mixture of (1), (2) and (3);
(1)
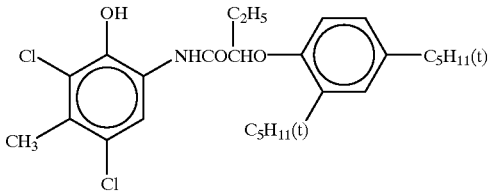
(2)
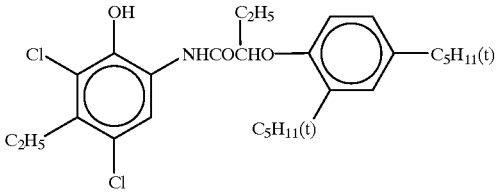
(3)
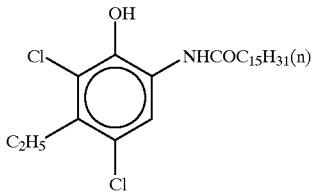
-continued
(Cpd-14)
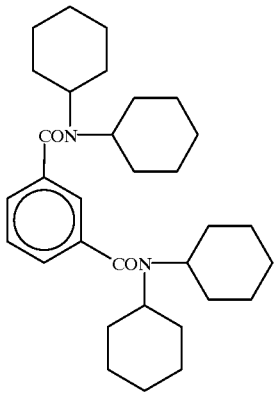
(Cpd-15)
1:1 Mixture of (1) and (2):
(1)
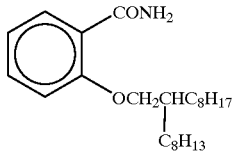
(2)
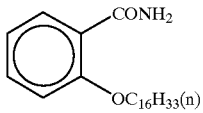
(Cpd-16)
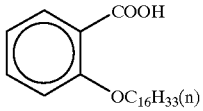
(Cpd-17)
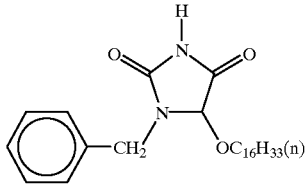
(Cpd-18)
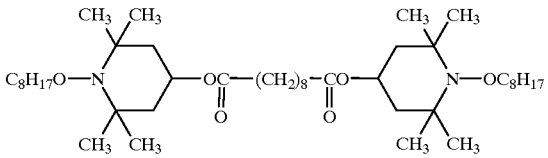
(Solv-8)
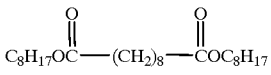

-continued (Solv-9)

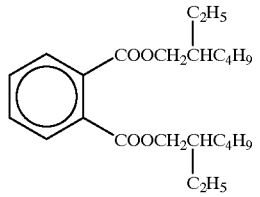

The thus prepared Sample Nos. 129 to 139 were each evaluated in the same way as in Example 1 to obtain results almost equal to those in Example 1. More specifically, it was confirmed that Sample No. 129 using the Emulsion A-01 spectrally sensitized by the comparative Sensitizing Dye A had the residual sensitizing dye problem, and Sample Nos. 130 to 134 using the Emulsions A-04 or C-04 to C-07 having no silver iodide-containing phase in the silver halide grains although they were spectrally sensitized by the present dyes were each reduced in residual sensitizing dye, but had the problem of the sensitivity drop upon storage; while, in analogy with Sample No. 110, the present Sample Nos. 135 to 139 were each reduced in residual sensitizing dye and inhibited from lowering the sensitivity upon storage.

EXAMPLE 3

Each of the Sample Nos. 101 to 139 was subjected to the same photographic processing (Processing A and Processing B each) as in Example 1, except that the brightening agent SR-12 used in the color developer for each photographic processing was changed to each of the brightening agents SR-3, SR-14 and SR-16, and thereby the results nearly equal to those obtained in Example 1 were achieved.

EXAMPLE 4

The evaluation of each of Sample Nos. 101 to 128 described in Example 1 was made by the same method as in Example 1, except that the exposure system was changed to the scanning exposure system described below. In this case also, it was confirmed that the results similar to those in Example 1 were obtained. For the scanning exposure of the samples, the same apparatus as disclosed in FIG. 1 of JP-A-8-16238 was employed. More specifically, the scanning exposure was performed using a second harmonic wave generating (SHG) light source wherein semiconductor laser having an oscillation wavelength of about 688 nm was combined with a non-linear optical crystal to emit a laser beam of 473 nm, and scanning the laser beam by means of a rotating polygon and moving a sample in the direction of the pivot of the rotating polygon simultaneously. The exposure amount was adjusted so as to provide continuously from the minimum developed color density to the maximum developed color density by continuously modifying the intensity of laser beam by means of an acoustic optical device synchronously with the movement of the sample. Therein, the scanning exposure was carried out at 400 dpi, and the average exposure time per pixel was about $8\times10^{-8}$ second. Further, the temperature of semiconductor laser was kept at constant by the use of a Peltier element in order to prevent the quantity of laser beam from varying with temperature.

Further, Emulsions A-34 to A-36 were prepared in the same manner as the comparative Emulsions A-04 to A-06 respectively wherein the silver iodide-containing phase was absent, except that the fine grains of silver bromide were not added at all. Furthermore, Emulsions A-44 to A-46 were prepared in the same manner as the present Emulsions A-14 to A-16 respectively wherein the silver iodide-containing phase was present at the grain surface, except that the fine grains of silver halide were not added at all. Then, Sample Nos. 140 to 145 were prepared in the same manner as Sample No. 101, except that the Emulsion A-01 was replaced by those Emulsions A-34 to A-36 and A-44 to A-46 respectively. With respect to the blue-sensitive emulsion layer in each sample, the photographic characteristic evaluation was made by examining the sensitivity under the condition that each sample was subjected to the aforementioned scanning exposure and Processing A. The term sensitivity as used herein refers to the reciprocal of an exposure amount required for providing the density of fog+0.6. The sensitivities are shown as relative values in Table 7, as the Sample No. 104 being taken as 100.

TABLE 7

| Sample | Emulsion | Iodide-containing phase | Sensitizing dye | AgBr localized phase | Scanning exposure sensitivity |
|---|---|---|---|---|---|
| 104 | A-04 | absent | I-(1) | present | 100 |
| 105 | A-05 | " | I-(2) | " | 105 |
| 106 | A-06 | " | I-(3) | " | 107 |
| 110 | A-14 | present (grain surface) | I-(1) | " | 129 |
| 111 | A-15 | present (grain surface) | I-(2) | " | 132 |
| 112 | A-16 | present (grain surface) | I-(3) | " | 141 |
| 140 | A-34 | absent | I-(1) | absent | 50 |
| 141 | A-35 | " | I-(2) | " | 53 |
| 142 | A-36 | " | I-(3) | " | 55 |
| 143 | A-44 | present (grain surface) | I-(1) | " | 102 |
| 144 | A-45 | present (grain surface) | I-(2) | " | 105 |
| 145 | A-46 | present (grain surface) | I-(3) | " | 112 |

As can be seen from Table 7, the sensitivity to scanning exposure was lowered by omitting the addition of fine grains of silver bromide, so that the presence of silver bromide localized phase was beneficial to the present silver halide emulsions. However, the lowering of sensitivity due to the omission of the formation of silver bromide localized phase was less in the present samples having an silver iodide-containing phase at the emulsion grain surface than in the comparative samples having no silver iodide-containing phase. Thus, the present invention has proved to be superior in scanning exposure suitability also.

In accordance with the present invention, the silver halide photographic materials obtained can have excellent rapid processability and high storage stability in the unused condition, and further they can be reduced in spectral sensitizing dyes remaining after processing.

What is claimed is:

1. A silver halide photographic material which comprises a support having provided thereon at least one light-sensitive emulsion layer containing silver halide grains having a silver chloride content of at least 95 mole %: wherein said silver halide grains each has a phase containing silver iodide in a proportion of at least 0.1 mole % for every 1 mole of total silver halides constituting the grains in the surface part situated outside the central part occupying at least 50% of the volume of each grain and, outside of this part, has no silver iodide-free layer or further has a silver iodide-free layer continuously or discontinuously the thickness of which is 0.002 $\mu$m or below; and said emulsion layer further comprises a compound represented by the following formula (I):

(I)

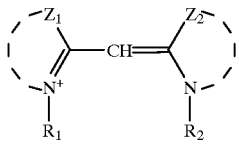

wherein $Z_1$ and $Z_2$ independently represent nonmetal atoms completing a benzothiazole ring which may have a substituent, excluding aromatic hydrocarbon groups and aromatic heterocyclic groups, or is fused together with —O—$CH_2$—O—; $R_1$ and $R_2$ independently represent an alkyl group; and $M_1$ represents a counter ion for neutralizing the intramolecular charge, or it is absent when the compound forms an inner salt.

2. A silver halide photographic material according to claim 1, wherein at least 50%, on a projected area basis, of the total silver halide grains comprised in the light-sensitive emulsion layer are tabular grains having an aspect ratio of at least 2 and (100) major surfaces.

3. A silver halide photographic material according to claim 1, wherein the silver halide grains each have (100) faces as substantially all the outer surfaces thereof.

4. A silver halide photographic material according to claim 1, wherein the silver halide grains contains metal ions or complex ions elected from the group consisting of the groups VIII and IIb metal ions and complex ions, lead ion and thallium ion.

5. A silver halide photographic material according to claim 1, wherein the compound of formula (I) is added in an amount of from $0.5\times10^{-6}$ to $1.0\times10^{-2}$ mole per mole of silver halide.

6. A silver halide photographic material according to claim 1, which further contains at least one of a pyrazoloazole coupler.

7. A silver halide photographic material according to claim 1, which further contains at least one of a pyrrolotriazole cyan coupler.

8. An image formation method comprising steps of exposing, color-developing and washing or/and stabilizing a silver halide photographic material according to claim 1, wherein the total time required for the washing and stabilizing steps is within 30 seconds and the processing time from the start of development to the end of the washing or stabilizing step as the last step is within 90 seconds.

9. An image formation of claim 8, wherein the color developer contains at least one of the compound represented by formula (II):

(II)

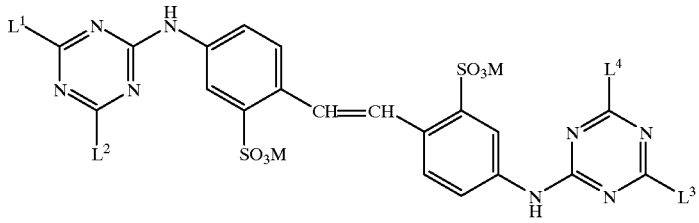

wherein $L^1$, $L^2$, $L^3$ and $L^4$ each represent —$OR^1$, —$NR^2R^3$ or —$N^+R^2R^3R^4X$, and $R^1$, $R^2$, $R^3$ and $R^4$ each represent a straight-chain or branched alkyl group, or a straight-chain or branched alkyl group having a substituent selected from the following members (III):

—$SO_3M$, —$OSO_3M$, —COOM, —NRX (III)

wherein X is a halogen ion and R is an alkyl group.

10. An image formation of claim 8, wherein the exposing step comprises performing a scanning-exposure to a modulated light beam for the exposure time of not less than $10^{-4}$ second in accordance with an image information.

11. An image formation method comprising steps of exposing, color-developing and washing or/and stabilizing a silver halide photographic material according to claim 1, wherein the exposing step comprises performing a scanning-exposure to a modulated light beam for the exposure time of not less than $10^{-4}$ second in accordance with an image information, followed by development processing.

* * * * *